US010114306B2

(12) United States Patent
Nomiya et al.

(10) Patent No.: US 10,114,306 B2
(45) Date of Patent: Oct. 30, 2018

(54) IMAGE FORMING METHOD

(71) Applicant: Konica Minolta, Inc., Tokyo (JP)

(72) Inventors: Makoto Nomiya, Tokyo (JP); Kaori Matsushima, Tokyo (JP); Yasuko Uchino, Tokyo (JP); Tomomi Oshiba, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/468,680

(22) Filed: Mar. 24, 2017

(65) Prior Publication Data

US 2017/0285503 A1 Oct. 5, 2017

(30) Foreign Application Priority Data

Mar. 30, 2016 (JP) ..... 2016-068377

(51) Int. Cl.

| | |
|---|---|
| ***G03G 13/01*** | (2006.01) |
| ***G03G 9/087*** | (2006.01) |
| ***G03G 9/08*** | (2006.01) |
| ***G03G 9/09*** | (2006.01) |
| ***G03G 15/01*** | (2006.01) |

(52) U.S. Cl.

CPC ..... *G03G 13/013* (2013.01); *G03G 9/0819* (2013.01); *G03G 9/0821* (2013.01); *G03G 9/08711* (2013.01); *G03G 9/08755* (2013.01); *G03G 9/08784* (2013.01); *G03G 9/091* (2013.01); *G03G 9/0902* (2013.01); *G03G 9/092* (2013.01); *G03G 9/0904* (2013.01); *G03G 9/0918* (2013.01); *G03G 9/0926* (2013.01); *G03G 15/0121* (2013.01); *G03G 2215/0135* (2013.01)

(58) Field of Classification Search

CPC .... G03G 13/013; G03G 13/01; G03G 9/0821; G03G 9/08784; G03G 9/08786; G03G 9/08788; G03G 9/08755

USPC ..... 430/45.1, 45.4, 45.5, 45.51, 107.1

See application file for complete search history.

(56) References Cited

FOREIGN PATENT DOCUMENTS

JP 2007248666 A 9/2007

OTHER PUBLICATIONS

Japanese Patent Office J-PlatPat machine-assisted English-language translation of Japanese Patent 2007-248666 (pub. Sep. 2007).*

* cited by examiner

*Primary Examiner* — Janis L Dote

(74) *Attorney, Agent, or Firm* — Lucas & Mercanti, LLP

(57) ABSTRACT

A high quality image excellent in low-temperature fixability and good in color stability can be formed by an image forming method of the present invention. In the image forming method, an image is formed by an electrophotographic method using toners of plural colors. Each of the toners of the plural colors contains a crystalline resin, methanol concentrations (%) at transmittance of 50% obtained for methanol wettability evaluation of the toners of the plural colors all fall in a range of 15 to 60%, and assuming that a maximum value and a minimum value of the methanol concentrations (%) at transmittance of 50% obtained for the methanol wettability evaluation of the toners of the plural colors are respectively WH (%) and WL (%), a relationship of $4 \leq WH - WL \leq 30$ is satisfied.

15 Claims, 1 Drawing Sheet

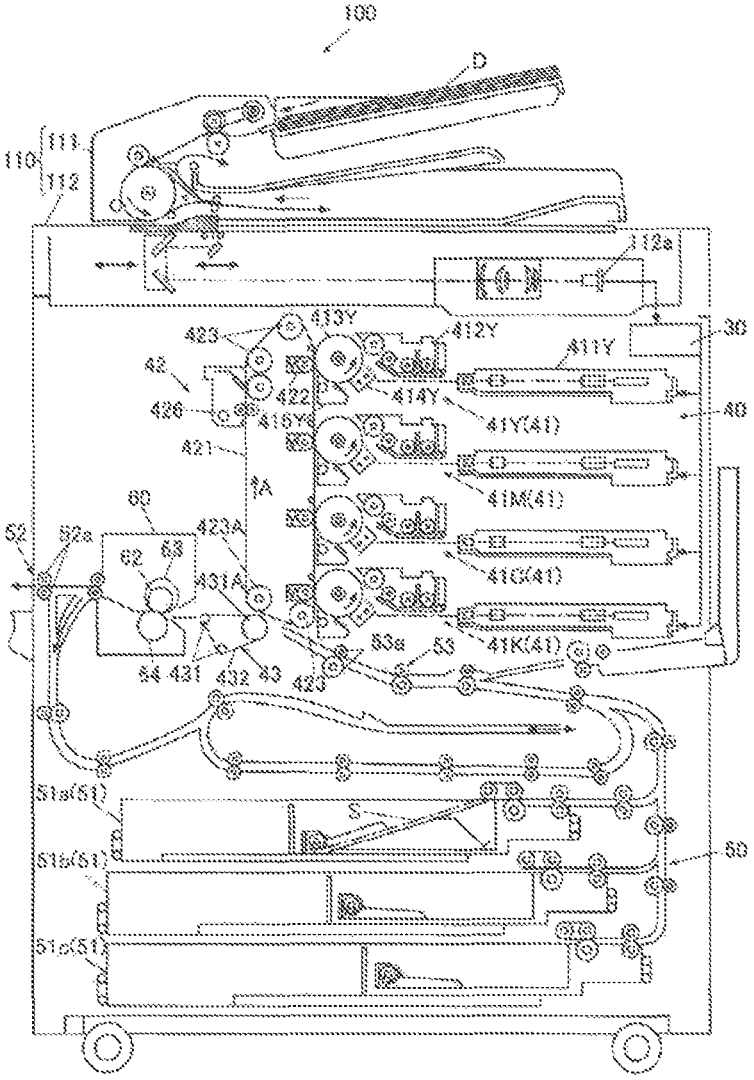
100
D
110
111
112
112a
30
413Y
412Y
411Y
423
42
422
414Y
41Y(41)
40
426
416Y
421
A
41M(41)
60
423A
52
52a
62
63
431A
41C(41)
41K(41)
83a
53
54
431
432
43
423
51a(51)
S
51b(51)
50
51c(51)

IMAGE FORMING METHOD

CROSS REFERENCE TO RELATED APPLICATIONS

This application is entitled to and claims the benefit of Japanese Patent Application No. 2016-068377, filed on Mar. 30, 2016, the disclosure of which including the specification, drawings and abstract is incorporated herein by reference in its entirety.

BACKGROUND OF THE INVENTION

1. Field of the Invention

The present invention relates to an electrophotographic image forming method.

2. Description of Related Art

Recently, in order to increase a printing speed and perform added-value printing in an electrophotographic image forming apparatus, a toner that can be heat-fixed at a lower temperature is demanded. Besides, with respect to color toners, in order to perform the added-value printing with a wide color range, examinations have been made on color toners containing various colorants and a clear toner containing no colorant. As the color toners containing various colorants, a white toner, a gold toner, a silver toner, a fluorescent toner and the like have been actively developed. For fixing various toners including such color toners and clear toner at a low temperature, use of a toner containing a crystalline resin is known (see, for example, Japanese Patent Application Laid-Open No. 2007-248666).

Each of toners of respective colors described in Japanese Patent Application Laid-Open No. 2007-248666 contains a crystalline polyester and a wax. A methanol concentration at transmittance of 50% obtained for methanol wettability evaluation of each of the toners (hereinafter sometimes referred to as the "methanol wettability evaluation value") is adjusted to fall in a range of 30 to 70%. Besides, assuming that a maximum value and a minimum value of the methanol wettability evaluation values of the toners are respectively WH (%) and WL (%), a relationship of WH (%)−WL (%)<3(%) is satisfied.

In full color printing using the toners of the respective colors described in Japanese Patent Application Laid-Open No. 2007-248666, the methanol wettability evaluation values are set to fall in the prescribed range, so that developability and image abrasion such as development streaks and fogging, and fixability such as image cracking can be improved.

Although the developability and the fixability are improved in the full color printing using the toners of the respective colors described in Japanese Patent Application Laid-Open No. 2007-248666, color reproducibility significant for the full color printing is still insufficient.

SUMMARY OF THE INVENTION

An object of the present invention is to provide an image forming method capable of forming a high quality image excellent in low-temperature fixability and good in color stability.

To achieve at least one of the above-mentioned objects, the present invention provides an image forming method for forming an image by an electrophotographic method using toners of plural colors reflecting one aspect of the present invention, in which each of the toners of the plural colors contains a crystalline resin, methanol concentrations (%) at transmittance of 50% obtained for methanol wettability evaluation of the toners of the plural colors are in a range of 15 to 60%, and assuming that a maximum value and a minimum value of the methanol concentrations (%) at transmittance of 50% obtained for the methanol wettability evaluation of the toners of the plural colors are respectively WH (%) and WL (%), the following expression 1 is satisfied:

$$4 \leq WH - WL \leq 30 \quad (1).$$

In one embodiment, all the methanol concentrations (%) at transmittance of 50% obtained for the methanol wettability evaluation of the toners of the plural colors fall in the range of 38 to 55%.

In one embodiment, the value WH−WL falls in a range of 10 to 20%.

In one embodiment, a toner having the minimum value WL (%) a black toner.

In one embodiment, the crystalline resin contained in a toner of at least one color among the toners of the plural colors is a hybrid crystalline resin containing a crystalline resin segment and an amorphous resin segment.

In one embodiment, the number of the plural colors of the toners is five or more.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein: FIGURE is a schematic diagram illustrating an example of an image forming apparatus in which toners of the present invention can be suitably used.

DESCRIPTION OF THE PREFERRED EMBODIMENTS

One embodiment of the present invention will now be described in detail.

An image forming method according to the present embodiment is an electrophotographic method for forming an image, and includes, for example, a charging step, a light exposing step, a developing step, a transferring step and a fixing step. The image forming method is a method for performing full color printing on a recording medium such as paper using specific toners of plural colors described later.

In order to perform the image forming method of the present embodiment, an image forming apparatus for general full color printing can be used. As described above, the image forming method includes, for example, the charging step, the light exposing step, the developing step, the transferring step and the fixing step.

In the charging step, an image carrier is charged by a charging device. The image carrier is, for example, a negative charge type organic photoconductor having photoconductivity. The organic photoconductor includes, for example, a conductive support, a charge generation layer, a charge transport layer, and a surface layer.

In the light exposing step, the charged image carrier is irradiated with light by a light exposing device or the like so as to form an electrostatic latent image thereon.

In the developing step, a toner is supplied to the image carrier on which the electrostatic latent image has been formed so as to form a toner image in accordance with the electrostatic latent image. The developing step can be performed by using, for example, a known developing device used in an electrophotographic image forming apparatus. Here, the "toner image" refers to aggregation of the toner in the shape of an image.

In the transferring step, the toner image having been formed on the image carrier is transferred to a recording medium such as paper. The transferring step can be performed by using, for example, a known transferring unit. For example, the transferring unit includes an intermediate transfer belt to which the toner image is transferred, and a cleaning device removing a portion of the toner remaining on the image carrier. The transferring step is performed preferably by an intermediate transfer system from the viewpoint of image quality.

In the fixing step, the toner image having been transferred to the recording medium is fixed on the recording medium by a known fixing device or the like.

Subsequently, the toners used in the image forming method of the present embodiment will be described. Each of the toners of the plural colors contains a crystalline resin, and methanol concentrations (%) at transmittance of 50% obtained for methanol wettability evaluation of the toners of the plural colors are all in a range of 15 to 60%. Besides, assuming that a maximum value and a minimum value of the methanol concentrations (%) at transmittance of 50% obtained for the methanol wettability evaluation of the toners of the plural colors are respectively WH (%) and WL (%), the following expression 1 is satisfied:

$$4 \leq WH - WL \leq 30 \quad (1)$$

First, a developer (a toner) using a toner particle will be described. The developer may be a one-component developer or a two-component developer. The one-component developer is made of a toner particle. The two-component developer is made of a toner particle and a carrier particle. The toner particle contains a toner base particle and an external additive adhering to the surface thereof. The toner base particle contains, for example, a binder resin, a colorant and a release agent. In the present embodiment, the toner (the developer) is preferably a two-component developer from the viewpoint of use in the full color printing.

The toner base particle may have a single-layer structure or a core/shell structure. Here, the "core/shell structure" means a structure including a core portion disposed inside and a shell portion disposed on the surface of the core portion. A toner base particle having the core/shell structure includes a resin particle (corresponding to the core portion) containing a colorant, a release agent and the like and having a comparatively low glass transition temperature, and a resin region (corresponding to the shell portion) formed on the surface of the core portion and having a comparatively high glass transition temperature. In the core/shell structure, the core portion may be completely coated by the shell portion, or the core portion may not be completely coated by the shell portion but may be partly exposed. It is noted that the shell portion can be formed through coagulation and fusion caused on the surface of the core portion. A cross-sectional structure of the core/shell structure can be confirmed, for example, using a known apparatus such as a transmission electron microscope (TEM) or a scanning probe microscope (SPM).

The toner of the present embodiment contains, for example, a binder resin, a release agent, a colorant, and an external additive. The binder resin contains a crystalline resin, and further contains an amorphous resin in general. Besides, the toner may contain a charge control agent.

The crystalline resin refers to a resin having no step-like endothermic change but having a definite endothermic peak in differential scanning calorimetry (DSC) of the crystalline resin or the toner particle. The term "definite endothermic peak" specifically means an endothermic peak having a half value width of 15° C. or less in the DSC measured at a temperature rise rate of 10° C./min. One crystalline resin may be singly used, or two or more crystalline resins may be used together.

The melting point (Tmc) of the crystalline resin is preferably 60° C. or more and 85° C. or less from the viewpoint of obtaining sufficient low-temperature fixability. The melting point (Tmc) can be measured by the DSC. Specifically, 0.5 mg of a sample of the crystalline resin is enclosed in an aluminum pan "KITNO. B0143013", the resultant pan is set in a sample holder of a thermal analyzer (Diamond DSC; manufactured by PerkinElmer, Inc.), and the temperature is varied in order of heating, cooling and heating. In the first heating and the second heating, the temperature is increased from room temperature (25° C.) to 150° C. at a temperature rise rate of 10° C./min, and the temperature of 150° C. is kept for 5 minutes, and in the cooling, the temperature is decreased from 150° C. to 0° C. at a temperature drop rate of 10° C./min, and the temperature of 0° C. is kept for 5 minutes. A temperature of a peak top of an endothermic peak on an endothermic curve obtained in the second heating is measured as the melting point Tmc.

The content of the crystalline resin in the toner base particle is preferably 2 to 30 mass % and is more preferably 5 to 20 mass % from the viewpoint of obtaining good low-temperature fixability. If the content is smaller than 2 mass %, a sufficient plasticizing effect cannot be obtained, and the low-temperature fixability may become insufficient in some cases. If the content exceeds 30 mass %, thermal stability and stability against physical stress of the resultant toner may become insufficient in some cases. When the content falls in the preferable range or the more preferable range described above, the resultant toner can be more easily controlled to have preferable viscoelasticity by, for example, selecting a composition of the amorphous resin or a suitable production method.

The crystalline resin is preferably a crystalline polyester from the viewpoint of, for example, thermal characteristics involved in the low-temperature fixability.

Besides, the crystalline polyester preferably has a weight average molecular weight (Mw) of 5,000 to 50,000 and a number average molecular weight (Mn) of 2,000 to 10,000 from the viewpoint of the low-temperature fixability and glossiness stably developed in a final image. The weight average molecular weight (Mw) and the number average molecular weight (Mn) can be obtained based on a molecular weight distribution measured by gel permeation chromatography (GPC) as described later.

A sample is added to tetrahydrofuran (THF) into a concentration of 1 mg/mL, and the thus obtained solution is dispersed for 5 minutes at room temperature using a ultrasonic disperser, and the resultant solution is allowed to pass through a membrane filter having a pore size of 0.2 μm to prepare a sample solution. A GPC apparatus (HLC-8120 GPC; manufactured by Tosoh Co., Ltd.) and columns (TSKguardcolumn and TSKgel Super HZ-m3 series; manufactured by Tosoh Co., Ltd.) are used, and with the temperature of the columns kept at 40° C., THF is caused to flow as a carrier solvent at a flow rate of 0.2 mL/min. Together with the carrier solvent, 10 μL of the prepared sample solution is injected into the GPC apparatus, and the sample is detected using a refractive index detector (RI detector). Then, a molecular weight distribution of the sample is calculated based on a calibration curve precedently measured using ten points of a monodisperse polystyrene standard particle.

The crystalline polyester is obtained by a polycondensation reaction between a di- or higher-valent carboxylic acid (a polycarboxylic acid) and a di- or higher-hydric alcohol (a polyhydric alcohol).

Examples of the polycarboxylic acid include dicarboxylic acids. One dicarboxylic acid may be singly used, or two or more dicarboxylic acids may be used together. The dicarboxylic acid is preferably an aliphatic dicarboxylic acid, and may further contain an aromatic dicarboxylic acid. The aliphatic dicarboxylic acid is preferably a straight chain dicarboxylic acid from the viewpoint of improving the crystallinity of the crystalline polyester.

Examples of the aliphatic dicarboxylic acid include oxalic acid, malonic acid, succinic acid, glutaric acid, adipic acid, pimelic acid, suberic acid, azelaic acid, sebacic acid, 1,9-nonandicarboxylic acid, 1,10-decanedicarboxylic acid, 1,11-undecanedicarboxylic acid, 1,12-dodecanedicarboxylic acid (dodecanedioic acid), 1,13-tridecanedicarboxylic acid, 1,14-tetradecanedicarboxylic acid, 1,16-hexadecanedicarboxylic acid, 1,18-octadecanedicarboxylic acid, lower alkyl esters of these, and anhydrides of these. In particular, from the viewpoint of easily attaining both the low-temperature fixability and the transferability, aliphatic dicarboxylic acids having 6 to 16 carbon atoms is preferred, and aliphatic dicarboxylic acids having 10 to 14 carbon atoms are more preferred.

Examples of the aromatic dicarboxylic acid include terephthalic acid, isophthalic acid, orthophthalic acid, t-butyl isophthalic acid, 2,6-naphthalene dicarboxylic acid and 4,4'-biphenyl dicarboxylic acid. From the viewpoint of easiness in availability and emulsification, the aromatic dicarboxylic acid is preferably terephthalic acid, isophthalic acid or t-butyl isophthalic acid.

In the crystalline polyester, the content of a constituent unit derived from the aliphatic dicarboxylic acid to a constituent unit derived from the dicarboxylic acid is preferably 50 mol % or more, more preferably 70 mol % or more, further preferably 80 mol % or more and particularly preferably 100 mol % from the viewpoint of sufficiently obtaining the crystallinity of the crystalline polyester.

An example of the polyhydric alcohol includes a diol. One diol may be singly used, or two or more diols may be used together. The diol is preferably an aliphatic diol, and may further contain another diol. The aliphatic diol is preferably a straight chain diol from the viewpoint of improving the crystallinity of the crystalline polyester.

Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,20-eicosanediol. In particular, from the viewpoint of attaining both the low-temperature fixability and the transferability, an aliphatic diol having 2 to 120 carbon atoms is preferably used, and an aliphatic diol having 4 to 6 carbon atoms is more preferably used.

Other examples of the diol include a diol having a double bond and a diol having a sulfonic acid group. Specifically, examples of the diol having a double bond include 2-butene-1,4-diol, 3-butene-1,6-diol and 4-butene-1,8-diol.

A content of a constituent unit derived from an aliphatic diol to a constituent unit derived from a diol in the crystalline polyester is preferably 50 mol % or more, more preferably 70 mol % or more, further preferably 80 mol % or more and particularly preferably 100 mol % from the viewpoint of improving the low-temperature fixability of the toner and the glossiness of an image to be finally formed.

A monomer constituting the crystalline polyester contains preferably 50 mass % or more, and more preferably 80 mass % or more of a straight chain aliphatic monomer. If an aromatic monomer is used, the melting point of the crystalline polyester is highly likely to be higher, and if a branched aliphatic monomer is used, the crystallinity is highly likely to be lower. Accordingly, a straight chain aliphatic monomer is preferably contained in the monomer. From the viewpoint of retaining the crystallinity of the crystalline polyester in the toner, the straight chain aliphatic monomer is used preferably at 50 mass % or more, and more preferably 80 mass % or more.

The crystalline polyester can be synthesized by polycondensation (esterification) of the polycarboxylic acid and the polyhydric alcohol with a known esterification catalyst used.

As the catalyst usable in the synthesis of the crystalline polyester, one or more catalysts may be used, and examples include alkali metal compounds such as sodium and lithium; compounds containing a group 2 element such as magnesium and calcium; metal compounds such as aluminum, zinc, manganese, antimony, titanium, tin, zirconium and germanium; phosphorous acid compounds; phosphoric acid compounds; and amine compounds.

Specifically, examples of a tin compound include dibutyltin oxide, tin octoate, tin dioctoate, and salts of these. Examples of a titanium compound include titanium alkoxides such as tetranormalbutyl titanate, tetraisopropyl titanate, tetramethyl titanate and tetrastearyl titanate; titanium acylates such as polyhydroxy titanium stearate; and titanium chelates such as titanium tetraacetylacetonate, titanium lactate, and titanium triethanol aluminate. An example of a germanium compound includes germanium dioxide, and examples of an aluminum compound include oxides such as polyaluminum hydroxide, aluminum alkoxide and tributyl aluminate.

A polymerization temperature of the crystalline polyester is preferably 150 to 250° C. Besides, a polymerization time is preferably 0.5 to 10 hours. During the polymerization, the reaction system may be placed in a reduced pressure state if necessary.

The amorphous resin is a resin having no crystallinity. The amorphous resin is, for example, a resin having no melting point in the differential scanning calorimetry (DSC) of the amorphous resin or the toner particle.

One amorphous resin may be singly used, or two or more amorphous resins may be used together. Examples of the amorphous resin include a vinyl resin, a urethane resin, a urea resin and amorphous polyesters such as a styrene-acrylic modified polyester. The amorphous resin is preferably a vinyl resin from the viewpoint of controllability of thermoplasticity.

The vinyl resin is, for example, a polymer of a vinyl compound, and examples include an acrylic acid ester resin, a styrene-acrylic acid ester resin and an ethylene-vinyl acetate resin. The vinyl resin is preferably a styrene-acrylic acid ester resin (a styrene-acrylic resin) from the viewpoint of plasticity obtained in heat fixing.

The styrene-acrylic resin is formed by addition polymerization of at least a styrene monomer and a (meth)acrylic acid ester monomer. The styrene monomer includes not only styrene represented by a structural formula of $CH_2{=}CH{-}$ $C_6H_5$ but also styrene derivatives having a known side chain or functional group in the styrene structure.

The (meth)acrylic acid ester monomer includes not only an acrylic acid ester and a methacrylic acid ester represented by $CH(R_1)=CHCOOR_2$ (wherein $R_1$ represents a hydrogen atom or a methyl group, and $R_2$ represents a $C_{1-24}$ alkyl group) but also acrylic acid ester derivatives and methacrylic acid ester derivatives having a known side chain or functional group in the structures of these esters.

Examples of the styrene monomer include styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene and p-n-dodecylstyrene.

Examples of the (meth)acrylic acid ester monomer include acrylic acid ester monomers such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate; and methacrylic acid esters such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate.

Herein, the term "(meth)acrylic acid ester monomer" is used as a generic name of an "acrylic acid ester monomer" and a "methacrylic acid ester monomer", and means one or both of these. For example, the term "methyl (meth)acrylate" means one or both of "methyl acrylate" and "methyl methacrylate".

One (meth)acrylic acid ester monomer may be singly used, or two or more (meth)acrylic acid ester monomers may be used together. For example, it is possible to form a copolymer by using a styrene monomer and two or more acrylic acid ester monomers, to form a copolymer by using a styrene monomer and two or more methacrylic acid ester monomers, and to form a copolymer by using a styrene monomer, an acrylic acid ester monomer and a methacrylic acid ester monomer.

From the viewpoint of controlling the plasticity of the amorphous resin, a content of a constituent unit derived from the styrene monomer in the amorphous resin is preferably 40 to 90 mass %. Besides, the content of a constituent unit derived from the (meth)acrylic acid ester monomer in the amorphous resin is preferably 10 to 60 mass %.

The amorphous resin may further contain a constituent unit derived from another monomer in addition to the styrene monomer and the (meth)acrylic acid ester monomer. The another monomer is preferably a compound ester-bonded to a hydroxy group (—OH) derived from a polyhydric alcohol or a carboxy group (—COOH) derived from a polycarboxylic acid. Specifically, the amorphous resin is preferably a polymer obtained by further polymerizing a compound that is addition polymerizable with the styrene monomer and the (meth)acrylic acid ester monomer and has a carboxy group or a hydroxy group (i.e., an amphoteric compound).

Examples of the amphoteric compound include compounds having a carboxy group such as acrylic acid, methacrylic acid, maleic acid, itaconic acid, cinnamic acid, fumaric acid, maleic acid monoalkyl ester and itaconic acid monoalkyl ester; and compounds having a hydroxy group such as 2-hydroxyethyl (meth)acrylate, 2-hydroxypropyl (meth)acrylate, 3-hydroxypropyl (meth)acrylate, 2-hydroxybutyl (meth)acrylate, 3-hydroxybutyl (meth)acrylate, 4-hydroxybutyl (meth)acrylate and polyethylene glycol mono(meth)acrylate.

A content of a constituent unit derived from the amphoteric compound in the amorphous resin is preferably 0.5 to 20 mass %.

The styrene-acrylic resin can be synthesized by a method of polymerizing a monomer using a known oil-soluble or water-soluble polymerization initiator. Examples of the oil-soluble polymerization initiator include an azo-based or diazo-based polymerization initiator and a peroxide-based polymerization initiator.

Examples of the azo-based or diazo-based polymerization initiator include 2,2'-azobis-(2,4-dimethylvaleronitrile), 2,2'-azobisisobutylnitrile, 1,1'-azobis-(cyclohexane-1-carbonytrile), 2,2'-azobis-4-methoxy-2,4-dimethylvaleronitrile and azobisisobutyronitrile.

Examples of the peroxide-based polymerization initiator include benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexyl)propane and tris-(t-butylperoxy) triazine.

If a resin particle of the styrene-acrylic resin is synthesized by emulsion polymerization, a water-soluble radical polymerization initiator can be used as the polymerization initiator. Examples of the water-soluble polymerization initiator include persulfates such as potassium persulfate and ammonium persulfate, azobisaminodipropane acetate, azobiscyanovaleric acid and a salt thereof, and hydrogen peroxide.

From the viewpoint of controllability of the plasticity of the amorphous resin, the weight average molecular weight (Mw) of the amorphous resin is preferably 5,000 to 150,000, and more preferably 10,000 to 70,000.

Incidentally, the structure of the crystalline resin and the monomer(s) contained therein affect the degree of the crystallinity and the heat of fusion of the crystalline resin. From the viewpoint of controlling the degree of the crystallinity of the crystalline resin to a range suitable for fixing, the crystalline resin is preferably a hybrid crystalline polyester (hereinafter sometimes simply referred to as the "hybrid resin"). One hybrid resin may be singly used or two or more hybrid resins may be used together. The hybrid resin may be replaced with the whole amount of the crystalline polyester, or replaced with a part of (namely, used together with) the crystalline polyester.

The hybrid resin is a resin in which a crystalline polyester resin segment (crystalline resin segment) and an amorphous resin segment are chemically bonded to each other. The crystalline polyester resin segment means a portion derived from the crystalline polyester. In other words, it means a molecular chain having the same chemical structure as a molecular chain constituting the crystalline polyester. The amorphous resin segment means a portion derived from the amorphous resin. In other words, it means a molecular chain having the same chemical structure as a molecular chain constituting the amorphous resin.

A weight average molecular weight Mw of the hybrid resin is preferably 5,000 to 100,000, more preferably 7,000 to 50,000, and particularly preferably 8,000 to 33,000 from the viewpoint of definitely attaining both sufficient low-temperature fixability and excellent long-term storage stability. If the weight average molecular weight Mw of the hybrid resin is 100,000 or less, the sufficient low-temperature fixability can be obtained. In contrast, if the weight average molecular weight Mw of the hybrid resin is 5,000 or more, the hybrid resin and the amorphous resin can be inhibited from becoming excessively compatible with each other during the storage of the toner, and an image failure due to fusion of the toner can be effectively inhibited.

The crystalline polyester resin segment may be, for example, a resin having a structure in which a main chain of the crystalline polyester resin segment is copolymerized with another component, or a resin having a structure in which a main chain of another component is copolymerized with the crystalline polyester resin segment. The crystalline polyester resin segment can be synthesized from the polycarboxylic acid and the polyhydric alcohol in the same manner as the crystalline polyester described above.

The content of the crystalline polyester resin segment in the hybrid resin is preferably 80 mass % or more and less than 98 mass % from the viewpoint of imparting sufficient crystallinity to the hybrid resin. A constituent component and a content of each resin segment in the hybrid resin (or in the toner) can be specified by any of known analysis methods such as nuclear magnetic resonance (NMR) and methylation pyrolysis gas chromatography/mass spectrometry (P-GC/MS).

The crystalline polyester resin segment preferably further contains a monomer having an unsaturated bond from the viewpoint of introducing, into this segment, a chemical binding site to the amorphous resin segment. An example of the monomer having an unsaturated bond includes a polyhydric alcohol having a double bond, and specific examples include polycarboxylic acids having a double bond such as methylenesuccinic acid, fumaric acid, maleic acid, 3-hexenedioic acid and 3-octenedioic acid; 2-butene-1,4-diol, 3-butene-1,6-diol and 4-butene-1,8-diol. A content of a constituent unit derived from the monomer having an unsaturated bond in the crystalline polyester resin segment is preferably 0.5 to 20 mass %.

The hybrid resin may be a block copolymer or a graft copolymer, and is preferably a graft copolymer. This is preferable because the orientation of the crystalline polyester resin segment can be easily controlled and sufficient crystallinity can be imparted to the hybrid resin, and more preferably, the crystalline polyester resin segment is grafted using the amorphous resin segment as a main chain. In other words, the hybrid resin is preferably a graft copolymer having a main chain of the amorphous resin segment and a side chain of the crystalline polyester resin segment.

Into the hybrid resin, a functional group such as a sulfonic acid group, a carboxy group or a urethane group may be introduced. The functional group may be introduced into the crystalline polyester resin segment or the amorphous resin segment.

The amorphous resin segment increases affinity between the amorphous resin and the hybrid resin constituting the binder resin. Owing to this segment, the hybrid resin can be easily incorporated into the amorphous resin, and hence the charge evenness of the toner can be further improved. A constituent component and a content of the amorphous resin segment in the hybrid resin (or in the toner) can be specified by, for example, any of known analysis methods such as the NMR and the methylation P-GC/MS.

From the viewpoint of improving the affinity with the binder resin and the charge evenness of the toner, the amorphous resin segment is preferably constituted by a resin of the same type as the amorphous resin contained in the binder resin. In this aspect, the affinity between the hybrid resin and the amorphous resin is further improved. The term "resins of the same type" means resins having the same characteristic chemical bond in their repeating units.

The term "characteristic chemical bond" complies with "Polymer Classification" described in National Institute for Materials Science (NIMS) Materials Database (http://polymer.nims.go.jp/PoLyInfo/guide/jp/term-s_polymer.html). Specifically, a chemical bond constituting 22 polymers in total, that is, polyacrylic, polyamide, polyanhydride, polycarbonate, polydiene, polyester, polyhaloolefin, polyimide, polyimine, polyketone, polyolefin, polyether, polyphenylene, polyphosphazene, polysiloxane, polystyrene, polysulfide, polysulfone, polyurethane, polyurea, polyvinyl and another polymer, is defined as the "characteristic chemical bond".

If the resin is a copolymer, when the copolymer contains, as a constituent unit, monomer species having the above-described chemical bond in chemical structures of a plurality of monomer species constituting the copolymer, "resins of the same type" means resins commonly having the characteristic chemical bond. Accordingly, even when resins have different characteristics from each other or molar component ratios between monomer species constituting copolymers are different, resins commonly having the characteristic chemical bond are regarded as the resins of the same type.

For example, a resin (or a resin segment) formed by styrene, butyl acrylate and acrylic acid and a resin (or a resin segment) formed by styrene, butyl acrylate and methacrylic acid are resins of the same type because they commonly have a chemical bond constituting polyacrylic. Besides, a resin (or a resin segment) formed by styrene, butyl acrylate and acrylic acid and a resin (or a resin segment) formed by styrene, butyl acrylate, acrylic acid, terephthalic acid and fumaric acid have, as a common chemical bond, at least a chemical bond constituting polyacrylic, and hence are regarded as resins of the same type.

Examples of the amorphous resin segment include vinyl, urethane and urea. From the viewpoint of the controllability of the thermoplasticity, the amorphous resin segment is preferably vinyl. The vinyl can be synthesized similarly to a vinyl-based resin.

The content of a constituent unit derived from the styrene monomer in the amorphous resin segment is preferably 40 to 90 mass % from the viewpoint of easy controllability of the thermoplasticity of the hybrid resin. From a similar point of view, a content of a constituent unit derived from the (meth)acrylic acid ester monomer in the amorphous resin segment is preferably 10 to 60 mass %.

From the viewpoint that the chemical binding site to the crystalline polyester resin segment is introduced into the amorphous resin segment, the amorphous resin segment preferably further contains the amphoteric compound described above. A content of a constituent unit derived from the amphoteric compound in the amorphous resin segment is preferably 0.5 to 20 mass %.

The content of the amorphous resin segment in the hybrid resin is preferably 3 mass % or more and less than 15 mass % from the viewpoint of imparting sufficient crystallinity to the hybrid resin.

The hybrid resin can be produced, for example, any of the following first to third production processes.

In the first production process, a polymerization reaction for synthesizing a crystalline polyester resin segment in the presence of a precedently synthesized amorphous resin segment is performed for producing a hybrid resin.

In this process, an amorphous resin is first synthesized by an addition reaction of the above-described monomer constituting the amorphous resin segment (preferably, a vinyl monomer such as a styrene monomer or a (meth)acrylic acid ester monomer). Next, in the presence of the amorphous resin segment, a polycarboxylic acid and a polyhydric alcohol are polymerized to synthesize a crystalline polyester resin segment. Here, the polycarboxylic acid and the polyhydric alcohol are subjected to condensation as well as the amorphous resin segment is subjected to an addition reaction to the polycarboxylic acid or the polyhydric alcohol, so as to synthesize a hybrid resin.

In the first process, into the crystalline polyester resin segment or the amorphous resin segment, a site capable of a reaction between these resin segments is preferably incorporated. Specifically, in synthesizing the amorphous resin segment, the above-described amphoteric compound is used in addition to a monomer constituting the amorphous resin segment. The amphoteric compound is reacted with a carboxy group or a hydroxy group contained in the crystalline polyester resin segment, and hence the crystalline polyester resin segment chemically and quantitatively bonds to the amorphous resin segment. Besides, in synthesizing the crystalline polyester resin segment, the monomer may be caused to contain the compound having an unsaturated bond described above.

Through the first process, a hybrid resin having a structure in which the crystalline polyester resin segment is molecularly bonded to the amorphous resin segment (i.e., a graft structure) can be synthesized.

In the second process, a crystalline polyester resin segment and an amorphous resin segment are respectively formed, and these segments are bonded to each other to produce a hybrid resin.

In this process, a crystalline polyester resin segment is first synthesized by condensation of a polycarboxylic acid and a polyhydric alcohol. Besides, separately from the reaction system for synthesizing the crystalline polyester resin segment, an amorphous resin segment is synthesized by addition polymerization of the monomer constituting the amorphous resin segment.

Here, into one of or both of the crystalline polyester resin segment and the amorphous resin segment, a site capable of a reaction between the crystalline polyester resin segment and the amorphous resin segment is preferably incorporated as described above.

Next, the crystalline polyester resin segment and the amorphous resin segment synthesized as above are reacted with each other, and thus, a hybrid resin having a structure in which the crystalline polyester resin segment and the amorphous resin segment are molecularly bonded to each other can be synthesized.

If the site capable of the reaction is incorporated into neither the crystalline polyester resin segment nor the amorphous resin segment, a compound having a site capable of bonding both the crystalline polyester resin segment and the amorphous resin segment may be added to a system in which both the crystalline polyester resin segment and the amorphous resin segment coexist. In this manner, a hybrid resin having a structure in which the crystalline polyester resin segment and the amorphous resin segment are molecularly bonded via the compound can be synthesized.

In the third production process, a hybrid resin is produced by performing a polymerization reaction for synthesizing an amorphous resin segment in the presence of a crystalline polyester resin segment.

In this process, a crystalline polyester resin segment is first synthesized by performing polymerization through condensation of a polycarboxylic acid and a polyhydric alcohol. Next, in the presence of the crystalline polyester resin segment, a monomer constituting an amorphous resin segment is polymerized to synthesize the amorphous resin segment. Here, into the crystalline polyester resin segment or the amorphous resin segment, a site capable of a reaction between these resin segments is preferably incorporated in the same manner as in the first production process described above.

In this manner, a hybrid resin having a structure in which the amorphous resin segment is molecularly bonded to the crystalline polyester resin segment (i.e., the graft structure) can be synthesized.

Among the first to third production processes, the first production process is preferably employed because a hybrid resin having a structure in which a crystalline polyester chain is grafted to an amorphous resin chain can be easily synthesized and production procedures can be simplified. Since the amorphous resin segment is precedently formed before binding to the crystalline polyester resin segment in the first production process, the orientation of the crystalline polyester resin segment can be easily made uniform. Accordingly, the first production process is preferred from the viewpoint of definitely synthesizing a hybrid resin suitable for the toner.

As the colorant, any of known inorganic colorants, known organic colorants and dyes can be used. Examples of a black colorant include carbon blacks such as furnace black, channel black, acetylene black, thermal black and lamp black, and magnetic powders such as magnetite and ferrite.

Examples of a magenta or red colorant include such as C.I. Pigment Red 2, 3, 5, 6, 7, 15, 16, 48:1, 53:1, 57:1, 60, 63, 64, 68, 81, 83, 87, 88, 89, 90, 112, 114, 122, 123, 139, 144, 149, 150, 163, 166, 170, 177, 178, 184, 202, 206, 207, 209, 222, 238 and 269.

Examples of an orange or yellow colorant include such as C.I. Pigment Orange 31 and 43, and C.I. Pigment Yellow 12, 14, 15, 17, 74, 83, 93, 94, 138, 155, 162, 180 and 185.

Examples of a green or cyan colorant include such as C.I. Pigment Blue 2, 3, 15, 15:2, 15:3, 15:4, 16, 17, 60, 62 and 66, and C.I. Pigment Green 7.

Besides, examples of a white colorant include inorganic pigments such as titanium oxide, heavy calcium carbonate, light calcium carbonate, titanium dioxide, aluminum hydroxide, titanium white, talc, calcium sulfate, barium sulfate, zinc oxide, magnesium oxide, magnesium carbonate, amorphous silica, colloidal silica, white carbon, kaolin, fired kaolin, delaminated kaolin, aluminosilicate, sericite, bentonite and smectite; and organic pigments such as a polystyrene resin particle and a urea formaldehyde resin particle. Other examples of the white colorant include pigments having a hollow structure (for example, inorganic pigments such as hollow silica). Besides, examples of a glitter colorant include metal powders of aluminum, brass, bronze, nickel, stainless steel, zinc and the like, mica coated by titanium oxide or yellow iron oxide, coated flaky inorganic crystal substrates of barium sulfate, layered silicate and layered aluminum silicate, single-crystal plate-shaped titanium oxide, basic carbonate, acid bismuth oxychloride, natural guanine, a flaky glass powder, and a metal-deposited flaky glass powder.

Examples of the dyes include C.I. Solvent Red 1, 49, 52, 58, 63, 111 and 122, C.I. Solvent Yellow 2, 6, 14, 15, 16, 19, 21, 33, 44, 56, 61, 77, 79, 80, 81, 82, 93, 98, 103, 104, 112 and 162, and C.I. Solvent Blue 25, 36, 60, 70, 93 and 95.

One of the above-described colorants may be singly used in the toner base particle, or two or more of these may be used together. A content ratio of colorant(s) (in total) in the toner base particle is preferably 1 to 30 mass %, and more preferably 2 to 20 mass % for each of the above-mentioned black, magenta, red, orange, yellow, green and cyan colorants. In the white colorant, a content ratio of colorant(s) (in total) in the toner base particle is preferably 10 to 50 mass %, and more preferably 10 to 40 mass %. Besides, in the glitter colorant, a content ratio of colorant(s) (in total) in the toner base particle is preferably 5 to 50 mass %. It is noted that the number of colors of the toners used in the present embodiment is not especially limited. The number may be four, five or more.

Examples of the release agent include low molecular weight polyolefins such as polyethylene, polypropylene and polybutene; silicones having a softening point when heated; fatty acid amides such as oleic acid amide, erucic acid amide, ricinoleic acid amide and stearic acid amide; vegetable waxes such as carnauba wax, rice wax, candelilla wax, haze wax and jojoba oil; animal waxes such as beeswax; hydrocarbon waxes such as paraffin wax, microcrystalline wax and Fischer-Tropsch wax; ester waxes such as stearyl stearate, behenyl behenate, butyl stearate, propyl oleate, glyceride monostearate, glyceride distearate, pentaerythritol tetrabehenate, diethylene glycol monostearate, dipropylene glycol distearate, diglyceride distearate, sorbitan monostearate and cholesteryl stearate. One of these release agents may be singly used, or two or more of these may be used together. A content ratio of the release agent in the toner base particle is preferably 1 to 25 mass %, and more preferably 3 to 17 mass %.

Examples of the charge control agent include metal complexes of salicylic acid derivatives with zinc or aluminum (salicylic acid metal complexes), calixarene compounds, organic boron compounds and fluorine-containing quaternary ammonium salt compounds. If the charge control agent is contained, a content ratio is preferably 0.1 to 10 parts by mass, and more preferably 0.5 to 5 parts by mass relative to 100 parts by mass of the binder resin contained in the toner.

The toner base particle may contain, on the surface thereof, an external additive such as a known inorganic particle, a lubricant or silica. The external additive imparts charging performance, flow ability, a cleaning property and the like to the toner. Examples of the inorganic particle include titanium oxide, and inorganic titanate compounds such as strontium titanate, zinc titanate and calcium titanate. Besides, the lubricant is, for example, a metal salt of a higher fatty acid. Examples of the lubricant include zinc stearate, aluminum stearate, copper stearate, magnesium stearate, calcium stearate, zinc oleate, manganese oleate, iron oleate, copper oleate, magnesium oleate, zinc palmitate, copper palmitate, magnesium palmitate, calcium palmitate, zinc linoleate, calcium linoleate, zinc ricinoleate and calcium ricinoleate. From the viewpoint of high-temperature storability and environmental stability, the aforementioned external additives may be subjected to a surface treatment with a silane coupling agent, a titanium coupling agent, a higher fatty acid, silicone oil or the like. One of these external additives may be singly used. Alternatively, an external additive formulation containing two or more of these external additives may be used. An addition amount of the external additives is preferably 0.05 to 5 parts by mass relative to 100 parts by mass of the toner base particle.

Here, the methanol concentration (%) at transmittance of 50% obtained for the methanol wettability evaluation of each of the toners of the plural colors will be described. It is noted that the "methanol concentration (%) at transmittance of 50% obtained for the methanol wettability evaluation of a toner" is sometimes referred to simply as the "methanol wettability evaluation value". The methanol wettability evaluation value is an index corresponding to the hydrophobic property on the surface of the toner. In each toner used in the image forming method of the present embodiment, the methanol wettability evaluation value can be controlled in accordance with the type of the release agent contained in the toner and the formulation of the external additive.

As described above, the methanol wettability evaluation values of the toners of the plural colors are all in the range of 15 to 60% in the present embodiment. If the methanol wettability evaluation value is lower than 15%, the affinity between the toner and an intermediate transfer belt becomes so high that the cleaning property of the intermediate transfer belt is lowered. On the other hand, if the methanol wettability evaluation value exceeds 60%, the affinity between the toner and a recording medium becomes so low that the adhesiveness of a toner image to the recording medium becomes low. Thus, if the methanol wettability evaluation value of the toner falls in the range of 15 to 60%, good low-temperature fixability and belt cleaning property can be attained. Besides, the methanol wettability evaluation values of the toners of the plural colors are preferably all in a range of 38 to 55%. If the methanol wettability evaluation values of the toners of the plural colors are in this range, the low-temperature fixability and the belt cleaning property can be further improved.

Besides, assuming that a maximum value and a minimum value of the methanol wettability evaluation values at transmittance of 50% obtained for the methanol wettability evaluation of the toners of the plural colors are respectively WH (%) and WL (%), the following expression 1 is satisfied:

$$4 \leq WH - WL \leq 30 \quad (1)$$

If the value WH (%)−WL (%) is smaller than 4%, a difference in charge amount becomes unavoidably large among the respective toners, and hence a difference in transferability among the toners of the respective colors cannot be improved. On the other hand, if the value WH (%)−WL (%) exceeds 30%, the affinity between the toners and an intermediate transfer belt is varied in accordance with environmental variation (a humidity in particular) among the toners. As a result, a secondary transfer ratio becomes largely different among the toners, and hence a color tone is varied on a recording medium. Besides, the value WH (%)−WL (%) is more preferably 10 to 20%.

In addition, a toner having the minimum value of the methanol concentrations (%) at transmittance of 50% obtained for the methanol wettability evaluation for the toners of the plural colors is preferably the black toner. As described above, the black toner contains carbon, and therefore, the charge amount is small, and the variation in the transfer ratio caused by the variation of the printing environment is larger than those of the toners of the other colors. Therefore, if the methanol wettability evaluation value of the black toner is low, the variation in the transfer ratio caused by the variation of the printing environment becomes smaller and becomes closer to the variation in the transfer ratio of the toners of the other colors. As a result, a good full color image can be obtained.

The methanol wettability evaluation value can be obtained as described in examples below.

The methanol wettability evaluation value can be adjusted by changing the type of the release agent and the type of the external additive formulation described above. For example, if an external additive surface-treated with a titanium coupling agent or titanium oxide is added to a toner, the methanol wettability evaluation value of the toner tends to become high. On the other hand, if an external additive surface-treated with a silane coupling agent or silicone oil, or silica is added to a toner, the methanol wettability evaluation value of the toner tends to become low.

The toner can be produced by any of a grinding method, a polymerization method and other known methods, or the like. Examples of the polymerization method include emulsion agglomeration (polymerization), association aggregation, dispersion polymerization, mini-emulsion, and other known methods. The production method for the toner is preferably the emulsion agglomeration (polymerization) capable of shape control for obtaining a uniform particle size. The emulsion agglomeration (polymerization) is preferred because this method is particularly good in that shape controllability can be attained by adding a specific inorganic salt to an aqueous medium, and in that progress of crystal growth can be easily controlled from the viewpoint of thermodynamic stability. Besides, from the viewpoint of production cost and production stability, the emulsion agglomeration (polymerization) is preferred because this method is good in that the particle size of the toner base particle can be easily reduced. In the emulsion agglomeration (polymerization), a dispersion of a particle of a resin produced by emulsification (hereinafter sometimes referred to as the "resin particle") is mixed with a dispersion of a colorant particle if necessary, the particles are agglomerated until a desired particle size is obtained, the shape control is further performed by fusion of the resin particle, and thus, a toner base particle is produced.

Next, an example of an image forming apparatus in which the toners of the present invention can be suitably used will be described. FIGURE is a diagram illustrating an example of the image forming apparatus in which the toners of the present invention can be used. As illustrated in FIGURE, image forming apparatus 100 includes image reading section 110, image processing section 30, image forming section 40, sheet conveying section 50 and fixing device 60.

Image forming section 40 includes image forming units 41Y, 41M, 41C and 41K respectively forming images of toners of respective colors of Y (yellow), M (magenta), C (cyan) and K (black). These image forming units have the same structure excluding the color of the toner contained therein, and hence are hereinafter sometimes referred to without using a sign corresponding to the color. Image forming section 40 further includes intermediate transfer unit 42 and secondary transfer unit 43. These units correspond to a transfer device.

Each image forming unit 41 includes exposing device 411, developing device 412, photoconductor drum 413, charging device 414 and drum cleaning device 415. Photoconductor drum 413 is, for example, a negative charge type organic photoconductor. The surface of photoconductor drum 413 is photoconductive. Photoconductor drum 413 corresponds to a photoconductor. Charging device 414 is, for example, a corona charger. Charging device 414 may be a contact charging device for charging photoconductor drum 413 by bringing a contact charging member, such as a charging roller, a charging brush or a charging blade, into contact with photoconductor drum 413. Exposing device 411 includes, for example, a semiconductor laser serving as a light source, and an optical deflecting device (polygon motor) irradiating photoconductor drum 413 with a laser beam in accordance with an image to be formed.

Developing device 412 is a two-component development type developing device. Developing device 412 includes, for example, a developer container for containing a two-component developer, a developing roller (a magnetic roller) rotatably disposed in an opening of the developer container, a partition for partitioning the developer container with the two-component developer allowed to pass therethrough, a conveyance roller for conveying a portion of the two-component developer disposed on the side of the opening of the developer container toward the developing roller, and a stirring roller for stirring the two-component developer held in the developer container. The developer container contains the above-described toner as the two-component developer.

Intermediate transfer unit 42 includes intermediate transfer belt 421, primary transfer roller 422 pressing intermediate transfer belt 421 against each photoconductor drum 413, plural support rollers 423 including backup roller 423A, and belt cleaning device 426. Intermediate transfer belt 421 is extended endlessly among plural support rollers 423. When at least one drive roller out of plural support rollers 423 rotates, intermediate transfer belt 421 runs at a constant speed in a direction of arrow A.

Secondary transfer unit 43 includes endless secondary transfer belt 432, and plural support rollers 431 including secondary transfer roller 431A. Secondary transfer belt 432 is extended, in a loop shape, among secondary transfer roller 431A and support rollers 431.

Fixing device 60 includes, for example, fixing roller 62, endless heating belt 63 covering an outer peripheral surface of fixing roller 62 and heating and melting a toner forming a toner image on sheet S, and pressure roller 64 pressing sheet S against fixing roller 62 and heating belt 63.

Image forming apparatus 100 further includes image reading section 110, image processing section 30 and sheet conveying section 50 as described above. Image reading section 110 includes sheet feeding device 111 and scanner 112. Sheet conveying section 50 includes sheet feed section 51, sheet ejection section 52 and conveyance path section 53. In three sheet feed tray units 51*a* to 51*c* included in sheet feed section 51, sheets S (including standard sheets and special sheets) identified based on weight or size are contained separately in accordance with types of sheets precedently set. Conveyance path section 53 includes a plurality of conveyance roller pairs such as registration roller pair 53*a*.

Procedures of image formation performed by image forming apparatus 100 illustrated in FIGURE will now be described. Scanner 112 optically scans and reads original D placed on a contact glass. Reflected light from original D is read by COD sensor 112*a* to obtain input image data. The input image data is subjected to prescribed image processing in image processing section 30, and the resultant is transferred to exposing device 411.

Each photoconductor drum 413 rotates at a constant peripheral speed. Charging device 414 evenly negatively charges the surface of photoconductor drum 413. In exposing device 411, a polygon mirror of the polygon motor rotates at a high speed, laser beams in accordance with respective color components of the input image data are developed along the axial direction of photoconductor drum 413, so as to irradiate the outer peripheral surface of photoconductor drum 413 along the axial direction. In this manner, an electrostatic image is formed on the surface of photoconductor drum 413.

In developing device 412, the toner particle is charged by stirring and conveying the two-component developer in the developer container, and the resultant two-component developer is conveyed to the developing roller, and forms a magnetic brush on the surface of the developing roller. The charged toner particle electrostatically adheres, from the magnetic brush, onto a portion of photoconductor drum 413 corresponding to the electrostatic latent image. In this manner, the electrostatic latent image on the surface of photoconductor drum 413 is visualized, and a toner image corresponding to the electrostatic latent image is formed on the surface of photoconductor drum 413.

The toner image formed on the surface of photoconductor drum 413 is transferred onto intermediate transfer belt 421 by intermediate transfer unit 42. A portion of the toner remaining on the surface of photoconductor drum 413 after the transfer is removed by drum cleaning device 415 having a drum cleaning blade brought into sliding contact with the surface of photoconductor drum 413.

Since intermediate transfer belt 421 is pressed against photoconductor drum 413 by primary transfer roller 422, a primary transfer nip is formed on each photoconductor drum by photoconductor drum 413 and intermediate transfer belt 421. In these primary transfer nips, toner images of the respective colors are successively transferred to be superimposed on intermediate transfer belt 421.

Secondary transfer roller 431A is pressed against backup roller 423A via intermediate transfer belt 421 and secondary transfer belt 432. Therefore, a secondary transfer nip is formed by intermediate transfer belt 421 and secondary transfer belt 432. Sheet S is conveyed by sheet conveying section 50 to the secondary transfer nip, and passes through the secondary transfer nip. A registration roller section including registration roller pair 53*a* corrects inclination of sheet S and adjusts conveying timing of sheet S.

When sheet S is conveyed to the secondary transfer nip, a transfer bias is applied to secondary transfer roller 431A. Through the application of the transfer bias, the toner image born on intermediate transfer belt 421 is transferred onto sheet S. Sheet S having the toner image transferred thereon is conveyed toward fixing device 60 by secondary transfer belt 432.

Fixing device 60 forms a fixing nip between heating belt 63 and pressure roller 64, so as to heat and press conveyed sheet S in the fixing nip. The toner particle constituting the toner image born on sheet S is heated, and hence a nucleating agent and the hybrid crystalline resin are rapidly melted therein, and as a result, the whole toner particle rapidly melts with a comparatively small amount of heat, and the toner component adheres to sheet S. In the melted and adhering toner component, the nucleating agent and a surrounding portion thereof are rapidly crystallized, and the whole component is rapidly solidified. Thus, the toner image is rapidly fixed on sheet S with a comparatively small amount of heat. Sheet S having the toner image fixed thereon is ejected out of the apparatus by sheet ejection section 52 including sheet ejection roller 52*a*. In this manner, a high quality image is formed.

Incidentally, a portion of the toner remaining on the surface of intermediate transfer belt 421 after the secondary transfer is removed by belt cleaning device 426 having a belt cleaning blade brought into sliding contact with the surface of intermediate transfer belt 421.

EXAMPLES

1. Preparation of Materials of Toners

First, methods for preparing respective materials of the toners will be described.

(1) Preparation of Crystalline Resin Particle Dispersions

A. Preparation of Crystalline Resin Particle Dispersion CD-1

A three-necked flask was charged with 180 parts by mass of 1,4-butanediol and 525 parts by mass of tetradecanedioic acid, 0.7 parts by mass of dibutyltin oxide and 0.4 parts by mass of hydroquinone were added thereto as catalysts, and a reaction was performed under a nitrogen gas atmosphere at 160° C. for 5 hours. The resultant was further reacted at 8.3 kPa and 160° C. until a resin having a desired melting point could be obtained, and thus, crystalline resin c-1 was obtained. When crystalline resin c-1 thus obtained was subjected to measurement with a differential scanning calorimeter (DSC) at a temperature rise rate of 10° C./min, a definite peak could be obtained. A temperature of a peak top of crystalline resin c-1 thus obtained was 78° C., and a half value width of the peak was 10° C. Besides, the weight average molecular weight (Mw) of crystalline resin c-1 was 24,800 and the number average molecular weight (Mn) thereof was 3,600.

Three hundred (300) parts by mass of crystalline resin c-1 in a melted state was transferred to an emulsion disperser (CAVITRON CD1010; manufactured by Eurotec Co., Ltd.) at a transfer rate of 100 parts by mass per min. At the same time as the transfer of crystalline resin c-1, 0.37 mass % dilute ammonia water, which was obtained by diluting reagent ammonia water with ion-exchanged water in an aqueous medium tank, was transferred to the emulsion disperser at a transfer rate of 0.1 liter per min while heating to 100° C. with a heat exchanger. Then, the emulsion disperser was operated at a rotational speed of a rotor of 60 Hz and a pressure of 5 kg/cm$^2$ (490 kPa) to prepare crystalline resin particle dispersion CD-1. It is noted that the dilute ammonia water was added so as to obtain a degree of neutralization of 48%. A dispersion diameter of a crystalline resin particle in crystalline resin particle dispersion CD-1 was 180 nm in terms of the median diameter based on the volume.

B. Preparation of Crystalline Resin Particle Dispersion CD-2

Material monomers, including a bireactive material monomer, of a resin (styrene acrylic resin: StAc1) segment for an addition polymerization system having the following composition and a radical polymerization initiator were put in a dropping funnel.

| | |
|---|---|
| Styrene | 34 parts by mass |
| n-Butyl acrylate | 12 parts by mass |
| Acrylic acid | 2 parts by mass |
| Polymerization initiator (di-t-butyl peroxide) | 7 parts by mass |

Besides, the following material monomers of a resin (crystalline polyester resin: CPEs1) segment for a polycondensation system were put in a four-necked flask equipped with a nitrogen introducing tube, a dehydration tube, a stirrer and a thermocouple, and were heated at 170° C. to be dissolved.

| | |
|---|---|
| Tetradecanedioic acid | 300 parts by mass |
| 1,6-Hexanediol | 131 parts by mass |

While stirring the contents of the four-necked flask, the material monomers of the resin (StAc1) for the addition polymerization system were added thereto in a dropwise manner over 90 minutes, the resultant was aged for 60 minutes, and unreacted portions of the material monomers of the resin for the addition polymerization system were removed under reduced pressure (8 kPa). Incidentally, the amount of monomers removed here was very small in terms of the ratio of the material monomers of the resin. Thereafter, 0.8 parts by mass of $Ti(OBu)_4$ was added thereto as an esterification catalyst, the temperature was increased to 235° C. to perform a reaction under normal pressure (101.3 kPa) for 5 hours. Subsequently, the reaction was performed under reduced pressure (8 kPa) for 1 hour. Next, the resultant was cooled to 200° C., and then reacted under reduced pressure (20 kPa) for 1 hour, and thus, hybrid crystalline polyester resin c-2 was obtained. A content of the resin (StAc1) segment excluding the resin (CPEs) segment to the total amount of 100 mass % of hybrid crystalline polyester resin c-2 (a hybrid ratio: HB ratio) was 10 mass %. Besides, hybrid crystalline polyester resin c-2 was a resin in which segment CPEs was grafted to segment StAc. The weight average molecular weight (Mw) of hybrid crystalline polyester resin c-2 was 30,000, the number average molecular weight (Mn) thereof was 5,900 and the melting point (Tm) thereof was 75.2° C.

In the preparation method for crystalline resin (crystalline polyester resin) particle dispersion CD-1, crystalline resin c-1 was replaced with hybrid crystalline resin c-2, and thus, crystalline resin particle dispersion CD-2 was obtained. A dispersion diameter of a crystalline resin particle in crystalline resin particle dispersion CD-2 was 175 nm in terms of the median diameter based on the volume.

(2) Preparation of Amorphous Resin Particle Dispersions

A. Preparation of Amorphous Resin Particle Dispersion VD-1

A reaction vessel equipped with a stirring device, a temperature sensor, a condenser and a nitrogen introducing device was charged with a solution obtained by dissolving 0.65 parts by mass of sodium dodecyl sulfate in 95 parts by mass of ion-exchanged water, and the inside temperature was increased up to 80° C. with stirring at a stirring rate of 230 rpm under a nitrogen stream. After increasing the temperature, a solution obtained by dissolving 0.47 parts by mass of potassium persulfate in 18 parts by mass of ion-exchanged water was added thereto, and the inside temperature was increased again to 80° C. Monomer mixed solution 1 having the following composition was added thereto in a dropwise manner over 1 hour, the resultant was heated at 80° C. for 2 hours followed by stirring for performing polymerization, and thus, resin particle 1H was prepared.

<Monomer Mixed Solution 1>

| | |
|---|---|
| Styrene | 30 parts by mass |
| n-Butyl acrylate | 7 parts by mass |
| Methacrylic acid | 2 parts by mass |

Monomer mixed solution 2 having the following composition was heated to 90° C. with stirring, 68 parts by mass of a paraffin wax (HNP-51; manufactured by Nippon Seiro Co., Ltd.) was dissolved as release agent W-1 in the mixed solution, and thus, monomer mixed solution 3 containing the release agent was prepared.

<Monomer Mixed Solution 2>

| | |
|---|---|
| Styrene | 280 parts by mass |
| n-Butyl acrylate | 78 parts by mass |
| n-Octyl-3-mercaptopropionate | 5.5 parts by mass |

A reaction vessel equipped with a stirring device, a temperature sensor, a condenser and a nitrogen introducing device was charged with a solution obtained by dissolving 5 parts by mass of sodium polyoxyethylene (2) dodecyl ether sulfate in 780 parts by mass of ion-exchanged water. Subsequently, the solution was heated to 98° C., monomer mixed solution 3 was added thereto, and the resultant was mixed and dispersed for 1 hour using a mechanical disperser having a circulating path (CLEARMIX (registered trademark); manufactured by M Technique Co., Ltd.) to prepare a dispersion containing an emulsion particle (an oil droplet). The resultant dispersion was then put in a reaction vessel, which was equipped with a stirring device, a temperature sensor, a condenser and a nitrogen introducing device, had been charged with 39 parts by mass of resin particle 1H (in terms of a solid content) and 1,000 parts by mass of ion-exchanged water, and had been set to have a stirring rotational speed of 90 rpm and an inside temperature of 82° C. Subsequently, to the resultant dispersion, an initiator solution obtained by dissolving 4.55 parts by mass of potassium persulfate in 87 parts by mass of ion-exchanged water was added. Then, the resultant system was heated and stirred at 82° C. for 1 hour for performing polymerization to obtain resin particle 1HM. Besides, a solution obtained by dissolving 6.07 parts by mass of potassium persulfate in 120 parts by mass of ion-exchanged water was added thereto, and monomer mixed solution 4 having the following composition in the following amount was further added thereto in a dropwise manner over 1 hour at 82° C. After completing the dropwise addition, the resultant was heated and stirred for 2 hours for performing polymerization, and then cooled to 28° C., and thus, vinyl resin particle dispersion VD-1 containing the release agent and the vinyl resin particle was obtained. A dispersion diameter of the vinyl resin particle in vinyl resin particle dispersion VD-1 thus obtained was 187 nm in terms of the median diameter based on the volume, the glass transition temperature (Tg) thereof was 56° C., and the weight average molecular weight (Mw) thereof was 34,000.

<Monomer Mixed Solution 4>

| | |
|---|---|
| Styrene | 205 parts by mass |
| n-Butyl acrylate | 100 parts by mass |
| Methacrylic acid | 18 parts by mass |
| n-Octyl-3-mercaptopropionate | 4.4 parts by mass |

B. Preparation of Amorphous Resin Particle Dispersion VD-2

Amorphous resin particle dispersion VD-2 was obtained in the same manner as amorphous resin particle dispersion VD-1 except that release agent W-1 was replaced with an ester wax NISSAN ELECTROL WEP-3; manufactured by NOF Corporation) used as release agent W-2. A dispersion diameter of a vinyl resin particle in amorphous resin particle dispersion VD-2 was 195 nm in terms of the median diameter based on the volume, the glass transition temperature (Tg) thereof was 58° C., and the weight average molecular weight (Mw) thereof was 37,000.

C. Preparation of Amorphous Resin Particle Dispersion VD-3

The following material monomers of a resin (an amorphous polyester resin) for a polycondensation system were put in a four-necked flask equipped with a nitrogen introducing tube, a dehydration tube, a stirrer and a thermocouple, and were heated at 170° C. to be dissolved.

| | |
|---|---|
| Bisphenol A propylene oxide 2-mol adduct | 285.7 parts by mass |
| Terephthalic acid | 66.9 parts by mass |
| Fumaric acid | 47.4 parts by mass |

Subsequently, to the thus obtained solution, 0.4 parts by mass of $Ti(OBu)_4$ was added as an esterification catalyst, and the resultant was heated to 235° C. to be reacted under normal pressure (101.3 kPa) for 5 hours. Then, the reaction was further performed under reduced pressure (8 kPa) for 1 hour. The thus obtained reaction solution was cooled to 200° C., and the reaction was performed under reduced pressure (20 kPa) until a desired softening point was obtained. Thereafter, the solvent was removed to obtain amorphous polyester resin V-3. The glass transition temperature (Tg) of amorphous polyester resin V-3 was 61° C., and the molecular weight (Mw) thereof was 19,000.

One hundred (100) parts by mass of amorphous polyester resin V-3 was dissolved in 400 parts by mass of ethyl acetate (manufactured by Kanto Chemical Co., Inc.). The thus obtained solution was mixed with 638 parts by mass of a 0.26 mass % sodium lauryl sulfate solution precedently prepared, and the resultant mixture was subjected to ultrasound dispersion with stirring by using an ultrasound homogenizer (US-150T; manufactured by Nippon Seiki Co., Ltd.) at V-LEVEL of 300 μA for 30 minutes. Thereafter, while heated to 40° C., the resultant was stirred under reduced pressure for 3 hours using a diaphragm vacuum pump (V-700; manufactured by BUCHI) to completely remove ethyl acetate. In this manner, amorphous resin particle dispersion VD-3 having a solid content of 13.5 mass % and containing a fine particle of amorphous resin 2 dispersed in an aqueous medium was obtained. A median diameter based on the volume of the particle in amorphous resin particle dispersion VD-3 was 190 nm.

(3) Preparation of Release Agent Dispersions

A. Preparation of Release Agent Dispersion WD-1

A mixed solution of 60 parts by mass of release agent W-1, 5 parts by mass of an ionic surfactant (NEOGEN RK; manufactured by Daiichi Kogyo Seiyaku Co., Ltd.) and 240 parts by mass of ion-exchanged water was heated to 95° C., the resultant mixed solution was sufficiently dispersed by using a homogenizer (ULTRA TURRAX T50; manufactured by IKA) followed by dispersion using a pressure-discharge type GAULIN HOMOGENIZER, and thus, release agent dispersion WD-1 having a solid content concentration of the release agent particle of 20 mass % was obtained. The volume average particle size of the particle contained in dispersion WD-1 was 240 nm.

B. Preparation of Release Agent Dispersion WD-2

Release agent dispersion WD-2 was prepared in the same manner as release agent dispersion WD-1 except that release agent W-1 was replaced with release agent W-2.

(4) Preparation of External Additive Formulations

A. Preparation of Externa Additive Formulation G1

External additive formulation G1 was obtained by mixing 1.7 parts by mass of silica fine particle A (NAX 50; manufactured by Nippon Aerosil Co., Ltd.), 0.3 parts by mass of silica fine particle B (R805; manufactured by Nippon Aerosil Co., Ltd.), 0.15 parts by mass of titanium oxide particle A (having a primary number average particle size of 85 nm; surface-treated with isobutyl trimethoxysilane), and 0.15 parts by mass of titanium oxide particle B (having a primary number average particle size of 20 nm; surface-treated with hexyl trimethoxysilane).

B. Preparation of External Additive Formulation G2

External additive formulation G2 was obtained by mixing 1.0 part by mass of silica fine particle A, 1.0 part by mass of silica fine particle B and 0.3 parts by mass of titanium oxide particle B.

C. Preparation of External Additive Formulation G3

External additive formulation G3 was obtained by mixing 0.4 parts by mass of silica fine particle A, 1.5 parts by mass of silica fine particle B and 0.4 parts by mass of titanium oxide particle B.

D. Preparation of External Additive Formulation G4

External additive formulation G4 was obtained by mixing 1.5 parts by mass of silica fine particle A, 0.3 parts by mass of silica fine particle B, 0.15 parts by mass of titanium oxide particle A, 0.15 parts by mass of titanium oxide particle B, and 0.15 parts by mass of calcium titanate (TC-100; manufactured by Titan Kogyo Ltd.).

E. Preparation of External Additive Formulation G5

External additive formulation G5 was obtained by mixing 0.8 parts by mass of silica fine particle A, 1.0 part by mass of silica fine particle B, 0.3 parts by mass of titanium oxide particle B, and 0.15 parts by mass of calcium titanate.

F. Preparation of External Additive Formulation G6

External additive formulation G6 was obtained by mixing 1.5 parts by mass of silica fine particle A, 0.3 parts by mass of silica fine particle B, 0.15 parts by mass of titanium oxide particle A, 0.15 parts by mass of titanium oxide particle B, and 0.3 parts by mass of calcium titanate.

(5) Preparation of Colorant Particle Dispersions

A. Preparation of Colorant Particle Dispersion 1

Ninety (90) parts by mass of sodium dodecyl sulfate was dissolved in 1,600 parts by mass of ion-exchanged water with stirring. To the resultant solution, 420 parts by mass of carbon black (REGAL (registered trademark) 330R; manufactured by Cabot Corporation) was slowly added under stirring. Subsequently, the resultant was dispersed using a stirring apparatus (CLEARMIX (registered trademark); manufactured by M Technique Co., Ltd.) to prepare colorant particle dispersion 1 in which a colorant particle was dispersed. A dispersion diameter of the colorant particle in colorant particle dispersion 1 measured with a microtrack UPA-150 (manufactured by Nikkiso Co., Ltd.) was 117 nm in terms of the median diameter based on the volume.

B. Preparation of Colorant Particle Dispersion 2

Colorant particle dispersion 2 was prepared in the same manner as colorant particle dispersion 1 except that carbon black was replaced with C.I. Pigment Blue 15:3.

C. Preparation of Colorant Particle Dispersion 3

Colorant particle dispersion 3 was obtained in the same manner as colorant particle dispersion 1 of the toner except that carbon black was replaced with C.I. Pigment Red 122 (quinacridone).

D. Preparation of Colorant Particle Dispersion 4

Colorant particle dispersion 4 was prepared in the same manner as colorant particle dispersion 1 except that carbon black was replaced with C.I. Pigment Yellow 74.

E. Preparation of Colorant Particle Dispersion 5

Colorant particle dispersion 5 was prepared as follows: Ninety (90) parts by mass of sodium dodecyl sulfate was added to 1,600 parts by mass of ion-exchanged water. To the thus obtained solution, 700 parts by mass of rutile-type titanium oxide (manufactured by Ishihara Sangyo Kaisha Ltd.) was slowly added under stirring. Thereafter, the resultant was dispersed using a stirring apparatus, and thus, colorant particle dispersion 5 was prepared.

F. Preparation of Colorant Particle Dispersion 6

Colorant particle dispersion 6 (solid content concentration: 10%) was prepared as follows: One hundred (100) parts by mass of an aluminum pigment (2173EA; manufactured by Toyo Aluminum K.K.) from which a solvent had been removed, 1.5 parts by mass of an anionic surfactant (NEOGEN R; manufactured by Daiichi Kogyo Seiyaku Co., Ltd.), and 900 parts by mass of ion-exchanged water were mixed and dissolved, and the resultant was dispersed for about 1 hour using an emulsion disperser CAVITRON (CR1010; manufactured by Pacific Machinery & Engineering Co., Ltd.).

2. Preparation of Toners (1) Preparation of Toner K1

A. Agglomerating/Fusing Step

A 5 L stainless steel reactor equipped with a stirring device, a condenser and a temperature sensor was charged with 46 parts by mass of crystalline resin particle dispersion CD-1 (in terms of a solid content), 454 parts by mass of amorphous resin particle dispersion VD-1 (in terms of a solid content), 40 parts by mass of colorant particle dispersion 1 (in terms of a solid content), and additionally 380 parts by mass of ion-exchanged water, and a 5 mol/L sodium hydroxide aqueous solution was further added thereto under stirring to adjust pH of the resultant to 10. Subsequently, a magnesium chloride aqueous solution obtained by dissolving 40 parts by mass of magnesium chloride hexahydrate in 40 parts by mass of ion-exchanged water was added thereto under stirring in a dropwise manner over 10 minutes. The inside temperature was increased to 75° C., a particle size was measured using MULTISIZER 3 (manufactured by Beckman Coulter Ind.; having an aperture size of 50 μm), and when a median diameter based on the volume of the particle reached 6.0 μm, a sodium chloride aqueous solution obtained by dissolving 160 parts by mass of sodium chloride in 640 parts by mass of ion-exchanged water was added thereto. The resultant was further heated and stirred, and when the average circularity of the particle measured using a flow particle image analyzer (FPIA-2100; manufactured by Sysmex Corporation) reached 0.960, the inside temperature was lowered to 25° C. at a cooling rate of 10° C./min, and thus, a dispersion of "toner base particle K1" was obtained.

B. Washing/Drying Step

The dispersion of toner base particle K1 obtained in the agglomerating/fusing step was subjected to solid-liquid separation using a basket centrifuge to form wet cake of the toner base particle. The wet cake was washed with ion-exchanged water at 35° C. until the electrical conductivity of a filtrate obtained by the basket centrifuge reached 5 μS/cm. Thereafter, the resultant wet cake was transferred to a flash jet dryer (manufactured by Seishin Enterprise Co., Ltd.) to be dried to a water content of 1.0 mass %, and thus, "toner base particle K1" was obtained.

C. External Additive Formulation Adding Step

To 100 parts by mass of toner base particle K1, external additive formulation G1 was added, and the resultant was mixed using a HENSCHEL MIXER to obtain toner K1.

(2) Preparation of Toner K2

Toner K2 was obtained in the same manner as toner K1 except that external additive formulation G1 was replaced with external additive formulation G2.

(3) Preparation of Toner K3

Toner K3 was obtained in the same manner as toner K1 except that external additive formulation G1 was replaced with external additive formulation G3.

(4) Preparation of Toner K4

Toner K4 was obtained in the same manner as toner K1 except that external additive formulation G1 was replaced with external additive formulation G4.

(5) Preparation of Toner K5

Toner K5 was obtained in the same manner as toner K1 except that external additive formulation G1 was replaced with external additive formulation G5.

(6) Preparation of Toner K6

Toner K6 was obtained in the same manner as toner K1 except that release agent W-1 was replaced with release agent W-2, and that amorphous resin particle dispersion VD-1 was replaced with amorphous resin particle dispersion VD-2.

(7) Preparation of Toner K7

Toner K7 was obtained in the same manner as toner K6 except that external additive formulation G1 was replaced with external additive formulation G2.

(8) Preparation of Toner K8

Toner K8 was obtained in the same manner as toner K6 except that external additive formulation G1 was replaced with external additive formulation G3.

(9) Preparation of Toner K9

Toner K9 was obtained in the same manner as toner K6 except that external additive formulation G1 was replaced with external additive formulation G4.

(10) Preparation of Toner K10

Toner K10 was obtained in the same manner as toner K5 except that release agent W-2 was replaced with release agent W-1, and that crystalline resin particle dispersion CD-1 was replaced with crystalline resin particle dispersion CD-2.

(11) Preparation of Toner K11

A. Agglomerating/Fusing Step

A reaction vessel equipped with a stirring device, a temperature sensor and a condenser was charged with 250 parts by mass of amorphous resin particle dispersion VD-3 (in terms of a solid content), 80 parts by mass of crystalline resin particle dispersion CD-1 (in terms of a solid content), and 1,000 parts by mass of ion-exchanged water, and a 5 mol/L sodium hydroxide aqueous solution was further added thereto to adjust pH of the resultant dispersion to 11. Subsequently, to the resultant dispersion, 40 parts by mass of colorant dispersion 1 (in terms of a solid content) was added, then 43.0 parts by mass of release agent dispersion WD-2 (in terms of a solid content), and an aqueous solution obtained by dissolving 60 parts by mass of a magnesium chloride in 60 parts by mass of ion-exchanged water was added under stirring at 30° C. over 10 minutes. The resultant was allowed to stand still for 3 minutes, and then the temperature was started to increase. The resultant dispersion was heated up to 80° C. over 60 minutes, and a particle growth reaction was continued with the temperature kept at 80° C. Under this condition, the particle size of an associated particle was measured using COULTER MULTISIZER 3 (manufactured by Beckman Coulter Ind.), and when the median diameter based on the volume of the associated particle reached 6.2 μm, an aqueous solution obtained by dissolving 190 parts by mass of sodium chloride in 760 parts by mass of ion-exchanged water was added to the dispersion contained in the reaction vessel to stop the particle growth. The resultant was further heated and stirred at 90° C. to promote fusion of the particle. When the average circularity of the particle measured using an average circularity measuring apparatus (FPIA-2100; manufactured by Sysmex Corporation) (with HPF detection number set to 4,000) reached 0.962, the dispersion contained in the reaction vessel was cooled to 30° C. at a cooling rate of 2.5° C./min, and thus, a dispersion of "toner base particle K11" was obtained.

B. Washing/Drying Step

The dispersion of toner base particle K11 obtained in the agglomerating/fusing step was subjected to solid-liquid separation using a basket centrifuge to form wet cake of the toner base particle. The wet cake was washed with ion-exchanged water at 35° C. until the electrical conductivity of a filtrate obtained by the basket centrifuge reached 5 μS/cm. Thereafter, the resultant wet cake was transferred to a flash jet dryer (manufactured by Seishin Enterprise Co., Ltd.) to be dried to a water content of 1.0 mass %, and thus, toner base particle K11 was obtained.

C. External Additive Formulation Adding Step

To 100 parts by mass of toner base particle K11, external additive formulation G1 was added, and the resultant was mixed using a HENSCHEL MIXER to obtain toner K11.

(12) Preparation of Toner K12

Toner K12 was obtained in the same manner as toner K11 except that external additive formulation G1 was replaced with external additive formulation G2.

(13) Preparation of Toner K13

Toner K13 was obtained in the same manner as toner K11 except that release agent dispersion WD-2 was replaced with release agent dispersion WD-1 and that crystalline resin particle dispersion CD-1 was replaced with crystalline resin particle dispersion CD-2.

(14) Preparation of Toner C1

Toner C1 was obtained in the same manner as toner K1 except that colorant particle dispersion 1 was replaced with colorant particle dispersion 2.

(15) Preparation of Toner C2

Toner C2 was obtained in the same manner as toner C1 except that external additive formulation G1 was replaced with external additive formulation G2.

(16) Preparation of Toner C3

Toner C3 was obtained in the same manner as toner C1 except that external additive formulation G1 was replaced with external additive formulation G3.

(17) Preparation of Toner C4

Toner C4 was obtained in the same manner as toner C1 except that external additive formulation G1 was replaced with external additive formulation G4.

(18) Preparation of Toner C5

Toner C5 was obtained in the same manner as toner C1 except that amorphous resin particle dispersion VD-1 was replaced with amorphous resin particle dispersion VD-2, that release agent W-1 was replaced with release agent W-2, and that external additive formulation G1 was replaced with external additive formulation G2.

(19) Preparation of Toner C6

Toner C6 was obtained in the same manner as toner C1 except that amorphous resin particle dispersion VD-1 was replaced with amorphous resin particle dispersion VD-2, that release agent W-1 was replaced with release agent W-2, and that external additive formulation G1 was replaced with external additive formulation G3.

(20) Preparation of Toner C7

Toner C7 was obtained in the same manner as toner C1 except that amorphous resin particle dispersion VD-1 was replaced with amorphous resin particle dispersion VD-2, that release agent W-1 was replaced with release agent W-2, and that external additive formulation G1 was replaced with external additive formulation G4.

(21) Preparation of Toner C8

Toner C8 was obtained in the same manner as toner C1 except that amorphous resin particle dispersion VD-1 was replaced with amorphous resin particle dispersion VD-2, that release agent W-1 was replaced with release agent W-2, and that external additive formulation G1 was replaced with external additive formulation G5.

(22) Preparation of Toner C9

Toner C9 was obtained in the same manner as toner C1 except that amorphous resin particle dispersion VD-1 was replaced with amorphous resin particle dispersion VD-2, that release agent W-1 was replaced with release agent W-2, and that external additive formulation G1 was replaced with external additive formulation G6.

(23) Preparation of Toner C10

Toner C10 was obtained in the same manner as toner C1 except that crystalline resin particle dispersion CD-1 was replaced with crystalline resin particle dispersion CD-2.

(24) Preparation of Toner C11

Toner C11 was obtained in the same manner as toner K11 except that colorant particle dispersion 1 was replaced with colorant particle dispersion 2, that release agent WD-2 was replaced with release agent WD-1, and that external additive formulation G1 was replaced with external additive formulation G2.

(25) Preparation of Toner C12

Toner C12 was obtained in the same manner as toner C11 except that external additive formulation G2 was replaced with external additive formulation G3.

(26) Preparation of Toner C13

Toner C13 was obtained in the same manner as toner C11 except that external additive formulation G2 was replaced with external additive formulation G4.

(27) Preparation of Toner C14

Toner C14 was obtained in the same manner as toner C11 except that crystalline resin particle dispersion CD-1 was replaced with crystalline resin particle dispersion CD-2.

(28) Preparation of Toner M1

Toner M1 was obtained in the same manner as toner K1 except that colorant particle dispersion 1 was replaced with colorant particle dispersion 3, and that external additive formulation G1 was replaced with external additive formulation G2.

(29) Preparation of Toner M2

Toner M2 was obtained in the same manner as toner M1 except that external additive formulation G2 was replaced with external additive formulation G4.

(30) Preparation of Toner M3

Toner M3 was obtained in the same manner as toner M11 except that external additive formulation G2 was replaced with external additive formulation G5.

(31) Preparation of Toner M4

Toner M4 was obtained in the same manner as toner M1 except that crystalline resin particle dispersion CD-1 was replaced with crystalline resin particle dispersion CD-2, and that external additive formulation G2 was replaced with external additive formulation G4.

(32) Preparation of Toner M5

Toner M5 was obtained in the same manner as toner K11 except that colorant particle dispersion 1 was replaced with colorant particle dispersion 3, that amorphous resin particle dispersion VD-1 was replaced with amorphous resin particle dispersion VD-2, that release agent dispersion WD-2 was replaced with release agent dispersion WD-1, and that external additive formulation G1 was replaced with external additive formulation G2.

(33) Preparation of Toner M6

Toner M6 was obtained in the same manner as toner M5 except that external additive formulation G2 was replaced with external additive formulation G4.

(34) Preparation of Toner M7

Toner M7 was obtained in the same manner as toner M5 except that crystalline resin particle dispersion CD-1 was replaced with crystalline resin particle dispersion CD-2.

(35) Preparation of Toner Y1

Toner Y1 was obtained in the same manner as toner K1 except that colorant particle dispersion 1 was replaced with colorant particle dispersion 4, that amorphous resin particle dispersion VD-1 was replaced with amorphous resin particle dispersion VD-2, and that release agent W-1 was replaced with release agent W-2.

(36) Preparation of Toner Y2

Toner Y2 was obtained in the same manner as toner Y1 except that external additive formulation G1 was replaced with external additive formulation G3.

(37) Preparation of Toner Y3

Toner Y3 was obtained in the same manner as toner Y1 except that crystalline resin particle dispersion CD-1 was replaced with crystalline resin particle dispersion CD-2.

(38) Preparation of Toner Y4

Toner Y4 was obtained in the same manner as toner K11 except that colorant particle dispersion 1 was replaced with colorant particle dispersion 4, and that release agent dispersion WD-2 was replaced with release agent dispersion WD-1.

(39) Preparation of Toner Y5

Toner Y5 was obtained in the same manner as toner Y4 except that release agent dispersion WD-1 was replaced with release agent dispersion WD-2, and that external additive formulation G1 was replaced with external additive formulation G4.

(40) Preparation of Toner Y6

Toner Y6 was obtained in the same manner as toner Y5 except that crystalline resin particle dispersion CD-1 was replaced with crystalline resin particle dispersion CD-2, and that release agent dispersion WD-1 was replaced with release agent dispersion WD-2.

(41) Preparation of Toner White-1

Toner white-1 was obtained in the same manner as toner K6 except that colorant particle dispersion 1 was replaced with 165 parts by mass of colorant particle dispersion 5 (in terms of a solid content).

(42) Preparation of Toner White-2

Toner white-2 was obtained in the same manner as toner white-1 except that external additive formulation G1 was replaced with external additive formulation G4.

(43) Preparation of Glitter Toner

A glitter toner was obtained in the same manner as toner K6 except that colorant particle dispersion 1 was replaced with 150 parts by mass of colorant particle dispersion 6 (in terms of a solid content).

3. Methanol Wettability Evaluation

A "methanol wettability evaluation value" was obtained by the following measurement using a powder wettability tester (WET-101P; manufactured by Rhesca Co., Ltd.).

In a laboratory environment, a stirrer chip having a length of 20 mm and 60 mL of ion-exchanged water at 25° C. were put in a 200 mL tall beaker, and the resultant beaker was set in the powder wettability tester (WET-101P; manufactured by Rhesca Co., Ltd.). Immediately after 25 mg of a toner was floated on the ion-exchanged water, a cover and a methanol supply nozzle were set, and the measurement was started simultaneously with the start of stirring with the stirrer. A supply rate of methanol (special grade methanol; Kanto Chemical Co., Ltd.) was set to 2.0 mL/min, and a measurement time was set to 70 minutes. Besides, a stirring rate of the stirrer was set to 380 to 420 rpm. In this evaluation method, a toner is floated on the interface of the ion-exchanged water at first, but as the methanol concentration is increased, the toner gradually becomes wet with a mixed liquid of the ion-exchanged water and the methanol to be dispersed in the liquid. As a result, the light transmittance of the liquid is gradually lowered. Based on the state of this lowering, the wettability is evaluated. Specifically, based on obtained data, the methanol concentration (vol %) calculated based on the supply amount (mL) of the methanol was plotted on the abscissa, the light transmittance (against a voltage) (%) was plotted on the ordinate, and a methanol concentration corresponding to an intermediate value between a maximum value and a minimum value of the light transmittance was defined as the "methanol wettability evaluation value".

Tables 1 to 3 below show the components and the methanol wettability evaluation values obtained in the methanol wettability test of the toners K1 to K13, C1 to C14, M1 to M7, Y1 to Y6, white-1 and white-2, and the glitter toner. Besides, Table 4 shows the components of external additive formulations. Further, Table 5 shows combinations of the respective toners (the toners K1 to K13, C1 to C14, M1 to M7, Y1 to Y6, white-1 and white-2, and the glitter toner) of toner sets 1 to 23, the wettability evaluation values and values of WH−WL (W %) of the respective toners.

TABLE 1

| Name of Toner | Crystalline Resin Particle Dispersion | Amorphous Resin Particle Dispersion | Release Agent/ Release Agent Dispersion | External Additive Formula-tion | Methanol Wettability Evaluation Value (%) |
|---|---|---|---|---|---|
| K1 | CD-1 | VD-1 | W-1 | G1 | 60 |
| K2 | CD-1 | VD-1 | W-1 | G2 | 58 |
| K3 | CD-1 | VD-1 | W-1 | G3 | 55 |
| K4 | CD-1 | VD-1 | W-1 | G4 | 50 |
| K5 | CD-1 | VD-1 | W-1 | G5 | 45 |
| K6 | CD-1 | VD-2 | W-2 | G1 | 40 |
| K7 | CD-1 | VD-2 | W-2 | G2 | 38 |
| K8 | CD-1 | VD-2 | W-2 | G3 | 16 |
| K9 | CD-1 | VD-2 | W-2 | G4 | 13 |
| K10 | CD-2 | VD-1 | W-1 | G5 | 45 |
| K11 | CD-1 | VD-3 | WD-2 | G1 | 40 |
| K12 | CD-1 | VD-3 | WD-2 | G2 | 35 |
| K13 | CD-2 | VD-3 | WD-1 | G1 | 39 |

TABLE 2

| Name of Toner | Crystalline Resin Particle Dispersion | Amorphous Resin Particle Dispersion | Release Agent/ Release Agent Dispersion | External Additive Formula-tion | Methanol Wettability Evaluation Value (%) |
|---|---|---|---|---|---|
| C1 | CD-1 | VD-1 | W-1 | G1 | 62 |
| C2 | CD-1 | VD-1 | W-1 | G2 | 55 |
| C3 | CD-1 | VD-1 | W-1 | G3 | 50 |
| C4 | CD-1 | VD-1 | W-1 | G4 | 44 |
| C5 | CD-1 | VD-2 | W-2 | G2 | 38 |
| C6 | CD-1 | VD-2 | W-2 | G3 | 35 |
| C7 | CD-1 | VD-2 | W-2 | G4 | 23 |
| C8 | CD-1 | VD-2 | W-2 | G5 | 18 |
| C9 | CD-1 | VD-2 | W-2 | G6 | 12 |
| C10 | CD-2 | VD-1 | W-1 | G4 | 44 |
| C11 | CD-1 | VD-3 | WD-1 | G2 | 54 |
| C12 | CD-1 | VD-3 | WD-1 | G3 | 43 |
| C13 | CD-1 | VD-3 | WD-1 | G4 | 30 |
| C14 | CD-2 | VD-3 | WD-1 | G2 | 53 |

TABLE 3

| Name of Toner | Crystalline Resin Particle Dispersion | Amorphous Resin Particle Dispersion | Release Agent/ Release Agent Dispersion | External Additive Formula-tion | Methanol Wettability Evaluation Value (%) |
|---|---|---|---|---|---|
| M1 | CD-1 | VD-1 | W-1 | G2 | 46 |
| M2 | CD-1 | VD-1 | W-1 | G4 | 43 |

TABLE 3-continued

| Name of Toner | Crystalline Resin Particle Dispersion | Amorphous Resin Particle Dispersion | Release Agent/ Release Agent Dispersion | External Additive Formula-tion | Methanol Wettability Evaluation Value (%) |
|---|---|---|---|---|---|
| M3 | CD-2 | VD-1 | W-1 | G4 | 43 |
| M4 | CD-1 | VD-1 | W-1 | G5 | 38 |
| M5 | CD-1 | VD-3 | WD-1 | G2 | 45 |
| M6 | CD-1 | VD-3 | WD-1 | G4 | 40 |
| M7 | CD-2 | VD-3 | WD-1 | G2 | 44 |
| Y1 | CD-1 | VD-2 | W-2 | G1 | 42 |
| Y2 | CD-1 | VD-2 | W-2 | G3 | 40 |
| Y3 | CD-2 | VD-2 | W-2 | G1 | 42 |
| Y4 | CD-1 | VD-3 | WD-1 | G1 | 62 |
| Y5 | CD-1 | VD-3 | WD-2 | G4 | 40 |
| Y6 | CD-2 | VD-3 | WD-2 | G4 | 39 |
| White-1 | CD-1 | VD-2 | W-2 | G1 | 62 |
| White-2 | CD-1 | VD-2 | W-2 | G4 | 42 |
| Glitter | CD-1 | VD-2 | W-2 | G1 | 42 |

TABLE 4

| External Additive Formulation | Silica Particle A (mass %) | Silica Particle B (mass %) | Titanium Oxide Particle A (mass %) | Titanium Oxide Particle B (mass %) | Calcium Titanate (mass %) |
|---|---|---|---|---|---|
| G1 | 1.7 | 0.3 | 0.15 | 0.15 | — |
| G2 | 1.0 | 1.0 | — | 0.30 | — |
| G3 | 0.4 | 1.5 | — | 0.40 | — |
| G4 | 1.5 | 0.3 | 0.15 | 0.15 | 0.15 |
| G5 | 0.8 | 1.0 | — | 0.30 | 0.15 |
| G6 | 1.5 | 0.3 | 0.15 | 0.15 | 0.30 |

TABLE 5

| Division | Toner Set No. | Toners yellow | magenta | Cyan | Black | Other | Hybrid Resin | Methanol Wettability Evaluation Value (%) yellow | magenta | Cyan | Black | Other | WH-WL |
|---|---|---|---|---|---|---|---|---|---|---|---|---|---|
| Examples | 1 | Y2 | M2 | C8 | K5 | — | — | 40 | 43 | 18 | 45 | — | 27 |
| | 2 | Y1 | M1 | C7 | K8 | — | — | 42 | 46 | 23 | 16 | — | 30 |
| | 3 | Y1 | M2 | C6 | K1 | — | — | 42 | 43 | 35 | 60 | — | 25 |
| | 4 | Y1 | M2 | C5 | K3 | — | — | 42 | 43 | 38 | 55 | — | 17 |
| | 5 | Y1 | M2 | C2 | K7 | — | — | 42 | 43 | 55 | 38 | — | 17 |
| | 6 | Y1 | M2 | C3 | K6 | — | — | 42 | 43 | 50 | 40 | — | 10 |
| | 7 | Y1 | M2 | C4 | K6 | — | — | 42 | 43 | 44 | 40 | — | 4 |
| | 8 | Y1 | M2 | C4 | K6 | White-2 | — | 42 | 43 | 44 | 40 | 42 | 13 |
| | 9 | Y1 | M2 | C4 | K6 | Glitter | — | 42 | 43 | 44 | 40 | 42 | 13 |
| | 10 | Y3 | M3 | C10 | K10 | — | Contained | 40 | 43 | 44 | 50 | — | 10 |
| | 11 | Y2 | M2 | C8 | K5 | — | — | 40 | 43 | 18 | 45 | — | 27 |
| | 12 | Y1 | M1 | C5 | K6 | — | — | 42 | 46 | 38 | 40 | — | 8 |
| | 13 | Y5 | M6 | C12 | K12 | — | — | 38 | 40 | 43 | 35 | — | 8 |
| | 14 | Y5 | M5 | C11 | K11 | — | — | 40 | 45 | 54 | 40 | — | 14 |
| | 15 | Y6 | M7 | C14 | K13 | — | Contained | 39 | 44 | 53 | 39 | — | 14 |
| Comparative Examples | 16 | Y2 | M4 | C9 | K9 | — | — | 40 | 38 | 12 | 13 | — | 28 |
| | 17 | Y2 | M2 | C1 | K3 | — | — | 40 | 43 | 62 | 55 | — | 22 |
| | 18 | Y2 | M2 | C4 | K5 | — | — | 42 | 43 | 44 | 45 | — | 3 |
| | 19 | Y2 | M2 | C7 | K2 | — | — | 40 | 43 | 23 | 58 | — | 35 |
| | 20 | Y2 | M2 | C1 | K9 | — | — | 40 | 43 | 62 | 13 | — | 49 |
| | 21 | Y2 | M2 | C1 | K9 | White-1 | — | 40 | 43 | 62 | 13 | 62 | 49 |
| | 22 | Y5 | M6 | C12 | K11 | — | — | 40 | 40 | 43 | 40 | — | 3 |
| | 23 | Y4 | M6 | C13 | K11 | — | — | 62 | 40 | 30 | 40 | — | 32 |

2. Evaluation

Toner sets 1 to 23 shown in Table 5 were subjected to the following evaluation tests.

(1) Evaluation of Low-Temperature Fixability

The image forming apparatus having the structure as illustrated in FIGURE was used as an image forming apparatus for the evaluation. Specifically, a modified machine of a commercially available full color multifunctional peripheral (BIZHUB (registered trademark) C754; manufactured by Konica Minolta, Inc.) modified so that surface temperatures of a fixing upper belt and a fixing lower roller could be changed was used as the image forming apparatus, and developers of respective color toners were charged in respective developing units. This image forming apparatus was used for performing the following test until a cold offset occurred. Under an environment of normal temperature and humidity (a temperature of 20° C. and a relative humidity of 50%), a solid image with a toner adhering amount of 2 mg/m$^2$ of the toner of each color and a toner adhering amount of 8 g/m$^2$ in total of the toners of four colors (10 g/m$^2$ of the toners of five colors) was output repeatedly on a recording medium ("MONDI Color Copy A4 90 g/m$^2$" (manufactured by Mondi) with a nip width set to 11.2 mm, a fixing time set to 34 msec, a fixing pressure set to 133 kPa, and with a fixing temperature changed from 100 to 200° C. at 5° C. intervals. Then, a lowest surface temperature of the fixing upper belt at which no cold offset occurred was found and defined as a lowest limit fixing temperature, and this lowest limit fixing temperature was used for evaluating the low-temperature fixability. Incidentally, in each of the following tests, the "fixing temperature" refers to the surface temperature of the fixing upper belt. Besides, as the lowest limit fixing temperature of a toner set is lower, it means that the toner set is better in the low-temperature fixability. The toner sets 1 to 23 were evaluated based on the following criteria.

It is noted that the toner sets 8, 9 and 21 were evaluated by using an image forming apparatus obtained by modifying the above-described image forming apparatus so that image formation could be performed using the toners of five colors.

In the present embodiment, those evaluated as A or B were determined to be at an acceptable level.

A: The lowest limit fixing temperature is 135° C. to 145° C.

B: The lowest limit fixing temperature is 150° C. to 165° C.

C: The lowest limit fixing temperature is 170° C. or higher.

(2) Evaluation of Stability in Color Reproducibility

As an image forming apparatus for the evaluation, a commercially available full color multifunctional peripheral (BIZHUB (registered trademark) C754; manufactured by Konica Minolta, Inc.) was modified so that a toner adhering amount ($g/m^2$) of a toner of each color adhering to a photoconductor in each developing unit could be adjusted, and the modified apparatus was set so that the toner of each color could be born on the photoconductor in a toner adhering amount of 1 $g/m^2$ under an environment of a temperature of 20° C. and a relative humidity of 20%.

In the same manner as in "Evaluation of Low-temperature Fixability", the toners of four (or five) colors were transferred onto the intermediate transfer belt to form an image of the superimposed four (or five) colors, and the resultant image was further secondary transferred onto a recording medium "MONDI Color Copy A4 90 $g/m^2$" (manufactured by Mondi). The transferred image was fixed with a nip width set to 11.2 mm, a fixing time set to 34 msec at a fixing pressure of 133 kPa and a fixing temperature of 180° C., and thus, a fixed image N was obtained.

Next, a fixed image H was obtained in the same manner as described above under an environment of a temperature of 35° C. and a relative humidity of 60%.

The fixed image N and the fixed image H were subjected to measurement using "MACBETH COLOR-EYE 7000" to obtain (L*a*b) values of the respective images, and a color difference index value Z was obtained based on these values in accordance with the following equation 3:

$$Z=\{(\Delta L)^2+(\Delta a)^2+(\Delta b)^2\}^{1/2} \quad (3)$$

Then, the toner sets 1 to 23 were evaluated based on the following criteria.

It is noted that the toner sets 8, 9 and 21 were evaluated by using an image forming apparatus obtained by modifying the above-described image forming apparatus so that image formation could be performed using the toners of five colors. In the present embodiment, those evaluated as A, B or C were determined to be at an acceptable level.

A: $1 \geq Z$

B: $1 < Z \leq 2$

C: $2 < Z \leq 3$

D: $3 < Z$ (3) Evaluation of Image Stability

As an image forming apparatus for the evaluation, a commercially available full color multifunctional peripheral (BIZHUB (registered trademark) C754; manufactured by Konica Minolta, Inc.) was used, the toners prepared as described above were charged as each of the above-described toner sets in respective developing devices, full-color printing of an entire halftone image (A4-size) having respective color densities of 10% was continuously performed under an environment of a temperature of 25° C. and a relative humidity of 50%, and thus, image stability was evaluated.

Specifically, after printing every 100,000 sheets, a halftone image was output for observation, and occurrence of image stain (fogging) and a white streak was checked, so as to count the number (PI) of sheets printed before the occurrence was found. Then, the toner sets 1 to 23 were evaluated based on the following criteria.

It is noted that the toner sets 8, 9 and 21 were evaluated by using an image forming apparatus obtained by modifying the above-described image forming apparatus so that image formation could be performed using the toners of five colors. In the present embodiment, those evaluated as A, B or C were determined to be at an acceptable level.

A: The occurrence is not found even after printing 100,000 or more sheets.

B: The occurrence is found when 80,000 or more and less than 100,000 sheets are printed.

C: The occurrence is found when 60,000 or more and less than 80,000 sheets are printed.

D: The occurrence is found before printing 60,000 sheets.

The evaluation results of the low-temperature fixability, the evaluation results of the stability in color reproducibility and the evaluation results of the image stability are shown in Table 6.

TABLE 6

| Division | Toner Set No. | Low-temperature Fixability | Color Reproducibility | Image Stability |
|---|---|---|---|---|
| Examples | 1 | A | C | C |
| | 2 | A | C | C |
| | 3 | B | B | B |
| | 4 | A | B | B |
| | 5 | A | A | B |
| | 6 | A | A | B |
| | 7 | A | C | B |
| | 8 | A | A | B |
| | 9 | A | A | B |
| | 10 | A | A | A |
| | 11 | B | C | C |
| | 12 | A | C | B |
| | 13 | A | C | B |
| | 14 | A | B | A |
| | 15 | A | A | A |
| Comparative Examples | 16 | B | C | D |
| | 17 | D | D | B |
| | 18 | B | D | B |
| | 19 | B | D | B |
| | 20 | D | D | D |
| | 21 | D | D | D |
| | 22 | B | D | B |
| | 23 | D | D | B |

As shown in Table 6, toner sets 18, 19 and 22, in which the methanol wettability evaluation values fall in the range of 15 to 60% but the difference between the maximum value and the minimum value of the methanol wettability evaluation values is out of the range of 4 to 30%, were poor in variation in color tone and the low-temperature fixability. This is probably because the secondary transfer ratio was largely different among the respective toners of the plural colors. Besides, toner set 16 containing the toners having a methanol wettability evaluation value of lower than 15% was poor in the cleaning property. This is probably because the affinity between the toners and the intermediate transfer belt was too high. Toner sets 17 and 23 containing the toner having a methanol wettability evaluation value exceeding 60% were poor in the variation in color tone and the low-temperature fixability. This is probably because adhesiveness of a toner image to a recording medium was lowered. Toner sets 20 and 21, in which the methanol wettability evaluation values are out of the range of 15 to 60% and the difference between the maximum value and the minimum value of the methanol wettability evaluation values is out of the range of 4 to 30%, were poor in all of the variation in color tone, the low-temperature fixability and the cleaning property.

Toner sets 1 to 23, in which the methanol wettability evaluation values fall in the range of 15 to 60% and the difference between the maximum value and the minimum value of the methanol wettability evaluation values falls in the range of 4 to 30%, were good in all of the variation in color tone, the low-temperature fixability and the cleaning property. In particular, toner sets 10 and 15 using crystalline resin particle dispersion CD-2 were better in all of the variation in color tone, the low-temperature fixability and the cleaning property. This is probably because these toner sets contained the hybrid crystalline resin. Besides, it was found that toner sets 4 to 9, 12 and 13, in which the methanol wettability evaluation values fall in a range of 38 to 55%, tended to be better in any of the variation in color tone, the low-temperature fixability and the cleaning property than toner sets 1 to 3, 11 and 13, in which the methanol wettability evaluation values are out of the range of 38 to 55%.

An image formed by the image forming method of the present invention is good in color stability and is of high quality. Accordingly, the electrophotographic image forming method is expected to be further spread by the present invention.

What is claimed is:

1. An image forming method for forming an image by an electrophotographic method comprising:

charging an image carrier with a charging device;

light exposing the charged image carrier with a light exposing device to form an electrostatic latent image on the image carrier;

developing the electrostatic latent image with toners of plural colors to form a toner image with the toners of the plural colors;

transferring the toner image to a recording medium; and fixing the toner image on the recording medium, wherein each of the toners of the plural colors contains a crystalline resin, methanol concentrations (%) at transmittance of 50% obtained for methanol wettability evaluation of the toners of the plural colors all fall in a range of 38 to 55%, and assuming that a maximum value and a minimum value of the methanol concentrations (%) at transmittance of 50% obtained for the methanol wettability evaluation of the toners of the plural colors are respectively WH (%) and WL (%), the following expression 1 is satisfied:

$$4 \leq WH - WL \leq 17 \quad (1).$$

2. The image forming method according to claim 1, wherein the value WH−WL falls in a range of 10 to 17%.

3. The image forming method according to claim 1, wherein a toner having the minimum value WL (%) is a black toner.

4. The image forming method according to claim 1, wherein the crystalline resin contained in a toner of at least one color among the toners of the plural colors is a hybrid crystalline resin containing a crystalline resin segment and an amorphous resin segment.

5. The image forming method according to claim 1, wherein the number of the plural colors of the toners is five or more.

6. An image forming method for forming an image by an electrophotographic method comprising:

charging an image carrier with a charging device;

light exposing the charged image carrier with a light exposing device to form an electrostatic latent image on the image carrier;

developing the electrostatic latent image with toners of plural colors to form a toner image with the toners of the plural colors;

transferring the toner image to a recording medium; and fixing the toner image on the recording medium, wherein each of the toners of the plural colors contains a crystalline resin, methanol concentrations (%) at transmittance of 50% obtained for methanol wettability evaluation of the toners of the plural colors all fall in a range of 15 to 60%, and assuming that a maximum value and a minimum value of the methanol concentrations (%) at transmittance of 50% obtained for the methanol wettability evaluation of the toners of the plural colors are respectively WH (%) and WL (%), the following expression 1 is satisfied:

$$10 \leq WH - WL \leq 20 \quad (1).$$

7. The image forming method according to claim 6, wherein all the methanol concentrations (%) at transmittance of 50% obtained for the methanol wettability evaluation of the toners of the plural colors fall in the range of 38 to 55%.

8. The image forming method according to claim 6, wherein a toner having the minimum value WL (%) is a black toner.

9. The image forming method according to claim 6, wherein the crystalline resin contained in a toner of at least one color among the toners of the plural colors is a hybrid crystalline resin containing a crystalline resin segment and an amorphous resin segment.

10. The image forming method according to claim 6, wherein the number of the plural colors of the toners is five or more.

11. An image forming method for forming an image by an electrophotographic method comprising:

charging an image carrier with a charging device;

light exposing the charged image carrier with a light exposing device to form an electrostatic latent image on the image carrier;

developing the electrostatic latent image with toners of plural colors to form a toner image with the toners of the plural colors;

transferring the toner image to a recording medium; and fixing the toner image on the recording medium, wherein each of the toners of the plural colors contains a crystalline resin, methanol concentrations (%) at transmittance of 50% obtained for methanol wettability evaluation of the toners of the plural colors all fall in a range of 15 to 60%, assuming that a maximum value and a minimum value of the methanol concentrations (%) at transmittance of 50% obtained for the methanol wettability evaluation of the toners of the plural colors are respectively WH (%) and WL (%), the following expression 1 is satisfied:

$$4 \leq WH - WL \leq 30 \quad (1), \text{ and}$$

the number of the plural colors of the toners is five or more.

12. The image forming method according to claim 11, wherein all the methanol concentrations (%) at transmittance of 50% obtained for the methanol wettability evaluation of the toners of the plural colors fall in the range of 38 to 55%.

13. The image forming method according to claim 11, wherein the value WH−WL falls in a range of 10 to 20%.

14. The image forming method according to claim 11, wherein a toner having the minimum value WL (%) is a black toner.

15. The image forming method according to claim 11, wherein the crystalline resin contained in a toner of at least one color among the toners of the plural colors is a hybrid crystalline resin containing a crystalline resin segment and an amorphous resin segment.

* * * * *